US009028369B2

(12) United States Patent
Hjort

(10) Patent No.: US 9,028,369 B2
(45) Date of Patent: May 12, 2015

(54) EXERCISE EQUIPMENT INTENDED FOR EXERCISING LEGS OF A PERSON

(75) Inventor: Martin Hjort, Ega (DK)

(73) Assignee: Innovaid A/S, Egå (DK)

( * ) Notice: Subject to any disclaimer, the term of this patent is extended or adjusted under 35 U.S.C. 154(b) by 360 days.

(21) Appl. No.: 13/508,877

(22) PCT Filed: Nov. 9, 2010

(86) PCT No.: PCT/DK2010/050298

§ 371 (c)(1),
(2), (4) Date: Sep. 26, 2012

(87) PCT Pub. No.: WO2011/057634

PCT Pub. Date: May 19, 2011

(65) Prior Publication Data

US 2013/0040782 A1 Feb. 14, 2013

(30) Foreign Application Priority Data

Nov. 12, 2009 (DK) ..... 2009 01210
Mar. 26, 2010 (DK) ..... 2010 00253

(51) Int. Cl.

*A63B 24/00* (2006.01)
*A63B 23/10* (2006.01)
*A61H 1/02* (2006.01)
(Continued)

(52) U.S. Cl.

CPC ..... *A63B 23/10* (2013.01); *A61H 1/0237* (2013.01); *A61H 1/0266* (2013.01); *A61H 2201/5007* (2013.01); *A61H 2201/5061* (2013.01); *A63B 21/00076* (2013.01); *A63B 21/00181* (2013.01); *A63B 21/1492* (2013.01); *A63B 21/158* (2013.01); *A63B 23/03525* (2013.01); *A63B 69/0057* (2013.01); *A63B 69/0064* (2013.01); *A63B 71/0009* (2013.01); *A63B 2069/0062* (2013.01); *A61H 1/0262* (2013.01)

(58) Field of Classification Search

USPC ..... 482/1–9, 146, 147, 900–902
See application file for complete search history.

(56) References Cited

U.S. PATENT DOCUMENTS 4,807,874 A 2/1989 Little
4,858,598 A * 8/1989 Halpern ..... 601/105
(Continued)

FOREIGN PATENT DOCUMENTS

DE 20316259 U1 12/2003
DE 20316259 U1 12/2003
(Continued)

*Primary Examiner* — Glenn Richman
(74) *Attorney, Agent, or Firm* — Gifford, Krass, Sprinkle, Anderson & Citkowski, P.C.

(57) ABSTRACT

The present invention relates to an exercise apparatus for exercising muscle groups in a person's legs by stretching and/or retraction, which exercise apparatus comprises at least a first frame and at least a first foot platform which foot platform is rotatable fastened to a hearing, which hearing is placed in relation to the person's foot for exercise at least plantar flexion and/or dorsal flexion, which exercise apparatus further includes a leg support. Hereby can be achieved exercising of the muscle groups by stretching and/or retraction (quadriceps lemons, biceps femoris, semitendinosus, semimembranosus, gastrocnememius, tibialis posterior, tibialis anterior, peroneus longus, peroneus brevis and soleus) in the legs of a person, and the muscles (soleus, gastrocnemius, tibialis posterior, peroneus brevis, peroneus longus, biceps femoris, semitendinosus, semimembranosus) at the back side of the legs.

15 Claims, 21 Drawing Sheets

The exercise apparatus.

(51) Int. Cl.

| | |
|---|---|
| ***A63B 21/00*** | (2006.01) |
| ***A63B 23/035*** | (2006.01) |
| ***A63B 69/00*** | (2006.01) |
| ***A63B 71/00*** | (2006.01) |

(56) References Cited

U.S. PATENT DOCUMENTS

| | | | | | |
|---|---|---|---|---|---|
| 4,944,309 | A | * | 7/1990 | Mechling | 600/595 |
| 5,049,079 | A | * | 9/1991 | Furtado et al. | 434/253 |
| 5,271,416 | A | * | 12/1993 | Lepley | 600/595 |
| 5,941,807 | A | * | 8/1999 | Cassidy et al. | 482/146 |
| 6,440,046 | B1 | | 8/2002 | Tholkes | |
| 6,543,769 | B1 | * | 4/2003 | Podoloff et al. | 273/148 B |
| 7,775,944 | B1 | * | 8/2010 | Shultz | 482/92 |
| 2006/0128537 | A1 | | 6/2006 | Philips | |

FOREIGN PATENT DOCUMENTS

| | | | |
|---|---|---|---|
| EP | 1629868 | A1 | 3/2006 |
| EP | 1629868 | A1 | 3/2006 |
| WO | WO-2009125397 | | 10/2009 |
| WO | 2009125397 | A3 | 12/2009 |

* cited by examiner

Figure 1: The exercise apparatus.

Figure 2: Leg support

Figure 3: Foot platforms and foot sensors.

Figure 4: Interface.

Figure 5: Leg support pad sensors

EXERCISE EQUIPMENT INTENDED FOR EXERCISING LEGS OF A PERSON

CROSS-REFERENCE TO RELATED APPLICATIONS

This application is the U.S. National Phase of PCT/DK2010/050298 filed Nov. 9, 2010, which claims priority of Danish Patent Applications PA 2009 01210 filed Nov. 12, 2009, and PA 2010 00253 filed Mar. 26, 2010.

FIELD OF THE INVENTION

The present invention relates to an exercise apparatus primarily for handicapped persons, for exercising the muscle groups in a person's legs by stretching and/or retraction, which exercise apparatus comprises at least a first frame and at least a first foot platform which foot platform is rotatable fastened to a bearing, which bearing is placed in relation to the person's foot for exercise at least plantar flexion and/or dorsal flexion, which exercise apparatus further includes a leg support.

BACKGROUND OF THE INVENTION

Until now exercise of physically handicapped persons has mainly been carried out by the handicapped person with the help of a physiotherapist (one to one). This has been a time-consuming exercise for both the handicapped person and for the physiotherapist as the best results are achieved though repeated intensive daily exercises.

U.S. Pat. No. 4,807,874 is related to an ankle rehabilitation and ankle fitness devices. The device is equipped with apparatus to adjust ankle position and varying amount of resistance which enables the user to progressively strengthen the ankle. The device also functions in a manner to enable the user to isolate and exercise the plantar and dorsal muscle groups of the lower leg and ankle joint, separately.

U.S. Pat. No. 6,440,046 relates to various systems that enable users with appreciably limited muscular, body and coordination control to assume ergonomic postures for task seating, standing, ambulation and physical exercise. Particularly, the embodiments of the invention provide secure support and positioning systems to safely aid the user through an entire process involving transfer from a wheel chair to the assemblies. The systems also assist the user to assume a desired posture and provide ergonomic and integral support after the user is situated in the desired posture. More particularly, the use of the present invention does not require the help of a therapist or additional muscle control on the part of the user. The systems of the present invention are advantageously structured and adjustably implemented to enable users, with a broad range of muscular and body coordination disabilities in addition to wide variations in physical size and configurations, to perform the many useful and advantageous activities safely and efficiently made possible by the invention.

OBJECT OF THE INVENTION

The present invention shall help, monitor and motivate the handicapped person to do exercises by him- or herself, e.g. at a rehabilitation facility or at home. The present invention shall also enable handicapped persons to do the exercises simultaneously in teams of more than one with or without supervision by one or more physiotherapists.

The object of the invention is to offer exercise equipment primarily to physically handicapped persons to be even helped as much as possible during their exercises. Furthermore the invention offers the possibility of doing the exercises in teams with a minimum of supervision from a physiotherapist.

A further object of the invention is to be able to keep a track or log of the exercising results in terms of measurable data like exercise intervals, a measure of how well the exercise was carried out, time, date and duration of the exercise.

The invention has the purpose of motivating the person using it by interactive exercises using a computer or gaming device as user interface with appropriate software programs. The apparatus can be used by any person, but is mostly intended to be used by persons suffering from different handicaps or diseases e.g. spastic hemiplegia, diplegia or tetraplegia, cerebrovascular accident (stroke), Parkinson's disease and Creutzfeldt-Jakob disease.

The primary indented use of the invention is both to exercise the muscle groups in a person's leg or legs by stretching and/or retraction and enhance the sub max muscle control of these muscle groups. The use of the invention is not limited to the primary use in any case.

In one aspect the invention relates to an exercise apparatus primarily for handicapped persons, for exercising and stretching muscle groups in a person's legs, which exercise apparatus comprises a frame, which frame including at least one support, which support or supports are connected to a upper frame, characterized in that the exercise apparatus includes at least one foot platform, the foot platform being rotatable fastened to a bearing, which bearing is placed in relation to the person's foot for exercise plantar flexion and dorsal flexion, that the exercise apparatus further includes a leg support and that the foot platform by angular movement is arranged to transform the angular movement to a mostly horizontal movement of the leg support.

In another aspect the invention relates to an exercise apparatus for exercising muscle groups in a person's legs by stretching and/or retraction, which exercise apparatus comprises at least a first frame, which frame including at least one support, which support or supports are connected to at least an upper frame, characterized in that the exercise apparatus includes at least one foot platform, the foot platform is rotatable fastened to a bearing, which bearing is placed in relation to the person's foot for exercise at least plantar flexion and/or dorsal flexion, which exercise apparatus further includes a leg support, and which foot platform by angular movement is arranged to transform the angular movement of the foot platform to a mostly horizontal movement of the leg support.

In a third aspect the invention relates to an exercise apparatus for exercising muscle groups in a person's legs by stretching and/or retraction, which exercise apparatus comprises at least a first frame and at least a first foot platform, characterized in that the foot platform, is rotatable fastened to a bearing, which bearing is placed in relation to the person's foot for exercise at least plantar flexion and/or dorsal flexion, which exercise apparatus further includes a leg support, and that the angular movement of the foot platform is individually controlled in relation to the mostly horizontal movement and/or position of the leg support.

In a fourth aspect the invention relates to a method for exercising one or two legs of a person by stretching or exercising at least plantar flexion or dorsal flexion and the muscle groups at the back of the legs, characterized in that at least the following steps are performed:

a: perform a measurement of the plantar or dorsal flexion at at least one force exerted at the foot platform or at the leg support, b: perform a plantar or dorsal flexion movement, c: perform transmission of the measurement of force or forces to a controller, d: the controller performs control of the plantar or dorsal flexion by restricting or actuating the movement.

In a fifth aspect the invention relates to the use of an exercise apparatus according to any of the other aspects for exercising at least plantar flexion or dorsal flexion of the legs and feet of a person.

DESCRIPTION OF THE INVENTION

The object can be achieved by an exercise apparatus as specified in the preamble of claim 1 which is peculiar in that the apparatus is provided with at least one foot platform, the foot platform being rotatable fastened to a bearing, which bearing is placed in relation to the person's foot for exercise plantar and dorsal flexion, that the exercise apparatus further includes a leg support, and that the foot platform by angular movement is arranged to transform the angular movement to a mostly horizontal movement of the leg support.

Hereby can be achieved exercises by stretching and/or retraction of the muscle groups (quadriceps femoris, biceps femoris, semitendinosus, semimembranosus, gastrocnemmius, tibialis posterior, tibialis anterior, peroneus longus, peroneus brevis and soleus) in the legs of a person, and the muscle groups (soleus, gastrocnemius, tibialis posterior, peroneus brevis, peroneus longus, biceps femoris, semitendinosus, semimembranosus) at the back side of the legs.

The long term effects of using the exercise and rehabilitation equipment according to the invention yield an improvement of the gross motor factor (a figure of a person's ability to control the motor functions while e.g. walking) and the spastic or contracted muscles or muscle groups in the legs can be stretched and prevent the spasticity of the muscles or muscle groups, hereby preventing tight muscles and fixed joints. The present invention can also be used in the fields of gait exercises after a stroke accident. Furthermore by using the exercise and rehabilitation equipment according to the invention the sub-max muscle control of the muscles groups and the plantar flexion and dorsal flexion in particular can be improved.

The foot platform and the leg support are directly connected at a common bearing. Hereby can be achieved a support for stretching the muscles of the legs while the plantar flexion and dorsal flexion of the foot is exercised in a simple implementation where no requirements are to adjust the gearing in between the two moving parts.

Preferably at least one foot platform may be connected to at least one restriction element. Hereby can be achieved a resistance to the force or movement exerted by the muscles or muscle groups so as to enhance the exercise. The restriction element can be any mechanical or electromechanical brake, actuator, piston, spring or alike.

At least one foot platform can be connected to at least one first actuator. Hereby can be achieved either a resistance to the force or movement exerted by the muscles or muscle groups or to help the movement exerted by the muscles or muscle groups so as to enhance the exercise.

Optionally, at least a first electric motor, which electric motor is mechanically connected to at least one foot platform for performing an angular movement of the foot platform. Hereby can be achieved an alternative implementation of the actuator, performing either a resistance to the force or movement exerted by the muscles or muscle groups or to help the movement exerted by the muscles or muscle groups so as to enhance the exercise.

At least one leg support can be connected to at least a second actuator. Hereby can be achieved individual exercises of either the plantar flexion and dorsal flexion or exercising the muscle groups of a person's leg or legs by stretching and/or retraction. The actuators can be controlled individually including locking the position of at least one of them, optionally while another is moving. In this way the exercises can be isolated to individual muscles or muscle groups.

One or more sensors are provided for measuring at least one force exerted at the foot platform or at the leg support. Hereby can be achieved a signal or a measurement of the actual force the person using the apparatus is applying to the foot platform while doing the exercise, and the actual force the person is applying to the leg support.

Optionally one or more of the sensors can be provided, preferably as one or more sensor arrays measuring the local actual force at the person's feet or legs. Hereby may be achieved a signal or a measurement of how and where the person's feet are positioned at the foot platforms and the position of the legs at the leg supports.

A controller, which controller receives signals from at least one of the sensors. Hereby can be achieved an output signal.

The output signal of the controller is transmitted to a user interface, such as computer system or gaming device, thus giving an audio and visual feedback signal to the user via a user interface.

The controller controls the actuators or motors hereby can be achieved a control of the movement, the position and/or the force exerted by the actuators or motors as a function of the input from the sensor or sensors.

Optionally the movement and/or position of the leg support is controlled individually from the movement and/or the position of the foot platform. The position and movement of the foot platform may be controlled by a signal obtained at one of the sensors at the foot platform. The position and movement of the leg support may alternatively be controlled by a signal obtained at one of the sensors at the leg support.

The exercise apparatus may include an interface receiving signals from at least one of the sensors, and where the interface generates an output signal. Hereby can be achieved an output signal from the apparatus to signal the force at the foot platforms, position of the feet at the foot platforms, the force of the legs exerted on the leg support and the position of the legs on the leg supports.

The output signal of the interface is transmitted to a computer system or gaming device. Hereby can be achieved an interactive training apparatus where the current status of the exercise and use can alter and trigger different events on the user interface and in the apparatus itself, e.g. controlling the speed, direction and position of the actuators. The interactive use of the apparatus can physically help the person to do the exercise by controlling one or more actuators, motivate the person doing the exercise and keep a track or log of the exercises performed by the person or persons using the apparatus. This may help the user to improve the exercises, keeping the pace of the exercise or holding the stretch or retraction of the muscle or monitoring muscles being stretched or retracted. Furthermore the user interface can show simple feedback as e.g. time summary or an indication of a score of how well the exercise is currently performed.

The support system can be adjusted in terms of height of the table, position and angle of leg support, the angle and gearing of the foot platforms to fit the user.

Optionally the object can be achieved by an exercise apparatus for exercising muscle groups in a person's legs by stretching and/or retraction, which exercise apparatus comprises at least a first frame and at least a first foot platform, which is peculiar in that the apparatus is provided that the foot platform is rotatable fastened to a bearing, which bearing is placed in relation to the person's foot for exercise at least plantar flexion and/or dorsal flexion, which exercise apparatus further includes a leg support and that the angular movement of the foot platform is individually controlled in relation to the mostly horizontal movement and/or position of the leg support.

Optionally the exercise apparatus measures at least one force acting at the foot platform which a measured first force dependent signal is transmitted towards a controller, which controller based on the first measured force dependent signal controls a second force acting at the foot platform. Hereby can be achieved a variable load or force to help or restricting the plantar or dorsal movement of the foot.

Optionally the exercise apparatus measures at least one force acting at the leg support, which a measured first force dependent signal is transmitted towards a controller, which controller based on the first measured force dependent signal controls a second force acting at the leg support. Hereby can be achieved a variable load or supporting force to the leg of the user, enabling the user to exercise the balance and ability to stand upright.

Optionally the exercise apparatus further comprises at least one support, which support or supports are connected to at least an upper frame, hereby can be achieved further physical support to hold the user.

The term "frame" used in the present description and claims should be interpreted as any structural material in any shape being able to fasten another structural element onto. Other examples of a frame could be a wooden plate, a H-shaped structural element. The frame may thus be comprised in or as a part of a chair and/or a wheel chair.

The term "upper frame" used in the present description and claims should be interpreted as any structural material in any shape fastened onto another structural element. Other examples of an upper frame could be a back or side support, a support for the spine of the person using the apparatus, an armrest of a chair and/or wheel chair.

The term "back support" used in the present description and claims should be interpreted as any material in any shape supporting the back of the user using the apparatus. The back support may be implemented as e.g. a bar, cushions, a strap, a belt or a chair.

Furthermore the interactive exercise program (software) can be selected and configured, optimized for the individual user of the equipment. The user interface can hold information and settings for the different user of the apparatus optimizing the exercise programs individually. Furthermore it can be able to keep a track of the exercising results in terms of measurable data like exercise interval, a measure of how well the exercise was carried out, time, date and duration of the exercise.

Furthermore the exercise data can be monitored via a local or remote computer to adjust the exercise program, alter settings and keeping a log of the exercise results. Optionally, the exercise apparatus comprises physical support in terms of cushions, handles, straps or table help the person using the equipment.

The present invention in one embodiment relates to an apparatus comprising a frame, a foot platform, controller and an actuator or motor, as described elsewhere herein. In another embodiment, however, the present invention relates to parts thereof, e.g. the frame, a foot platform, controller and an actuator or motor and not including the other elements e.g. the support, upper frame and leg support. In a particular embodiment, the invention relates to a fully or partly standalone module or as a module to fit onto e.g. a table, bed, chair or wheel chair. The advantages of this embodiment includes easy access to the exercise apparatus for wheel chair users, the mobility and light weight of the apparatus and lower cost.

It is to be noticed that the term "comprising", used in the present description and claims should not be interpreted as being restricted to the means listed thereafter; it does not exclude other elements or steps. Thus, the scope of the expression "a device comprising means A and B" should not be limited to devices consisting of only components A and B. It means that with respect to the present invention, the only relevant components are A and B.

The present invention shall help, monitor and motivate the handicapped person to do exercises by him- or herself e.g. at a rehabilitation facility or at home. The present invention may also enable multiple handicapped persons to do the exercises simultaneously in teams of more than one with or without supervision by one or more physiotherapist.

DESCRIPTION OF THE DRAWINGS

The below figures (FIGS. 6-12) indicates a second embodiment for the invention

The below figures (FIGS. 13-17) indicates a third embodiment for the invention

DETAILED DESCRIPTION OF EMBODIMENTS OF THE INVENTION

Figure 1:
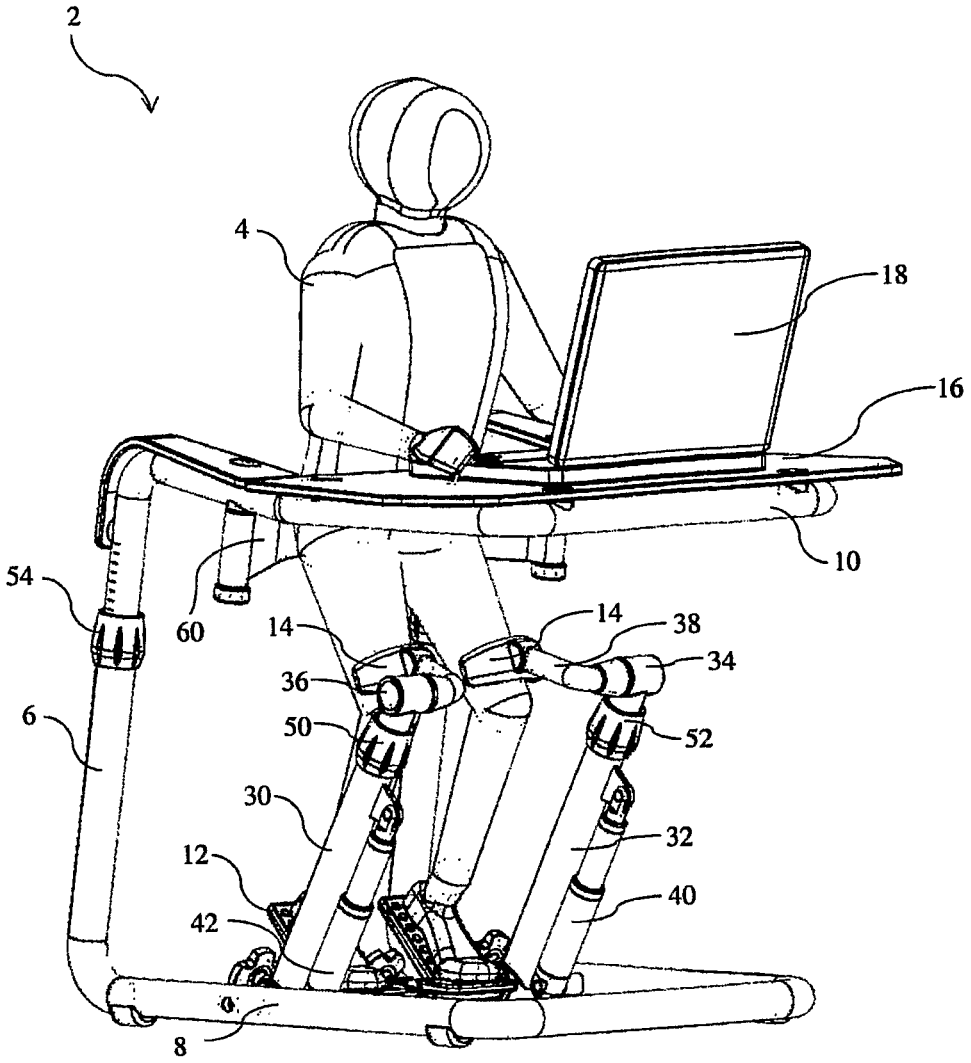
FIG. 1: The exercise apparatus according to the invention in a perspective view from the front.

Referring to FIG. 1, the exercise equipment (2) is shown in a front/side view. A person using the equipment (4) is not a part of the invention. The height of the table (16) may be adjusted by adjustment screws (54) on the vertical support frame (6). The lower horizontal support frame (8) ensures that the exercise equipment is stable during exercising. The upper support frame (10) holds the table plate (16) where a user interface, e.g. a laptop computer (18) or gaming device can be placed. The legs of person using the exercise equipment (4) are positioned against the leg support pads (14) and the feet on the foot platforms (12). The height of the leg supports pads (14) can be adjusted by the adjustment screws (50, 52). Each leg support comprises a support pad (14) with integrated force sensors, an extension part (38), a bearing (34, 36), the main leg support (30, 32) and a linear actuator (40, 42). The linear actuators (40, 42) are fastened at each end at a bearing (44, 46). To further hold the person using the exercise equipment in the right position a back support (60) is placed at the bottom of the user (4).

Figure 2:
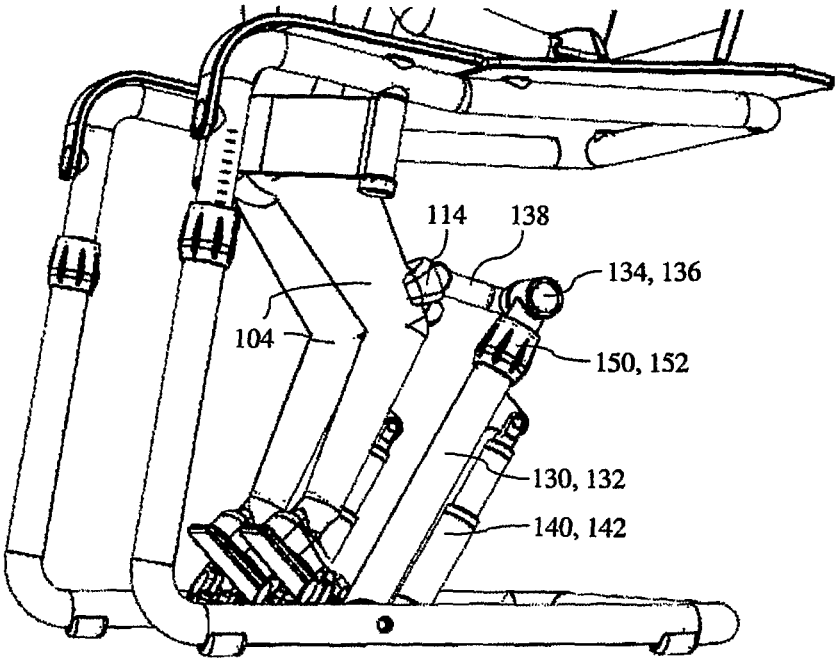
FIG. 2: A detail of a leg support of the apparatus in FIG. 1.

Referring to FIG. 2, the legs (104) of the user is shown positioned against the leg support pad (114). The leg support pads (114) have integrated force sensors to measure the actual force the user is applying to the leg support pad (114). The bearing (134, 136) and the extension part (138) holding the leg support pad can rotate to fit the position of the leg during the exercises. The position of the leg support can be adjusted using the adjustment screw (150, 152). The actuators (140, 142) and the main leg supports (130, 132) shall help moving the leg support pad (114) in a mainly horizontal direction.

Figure 3:
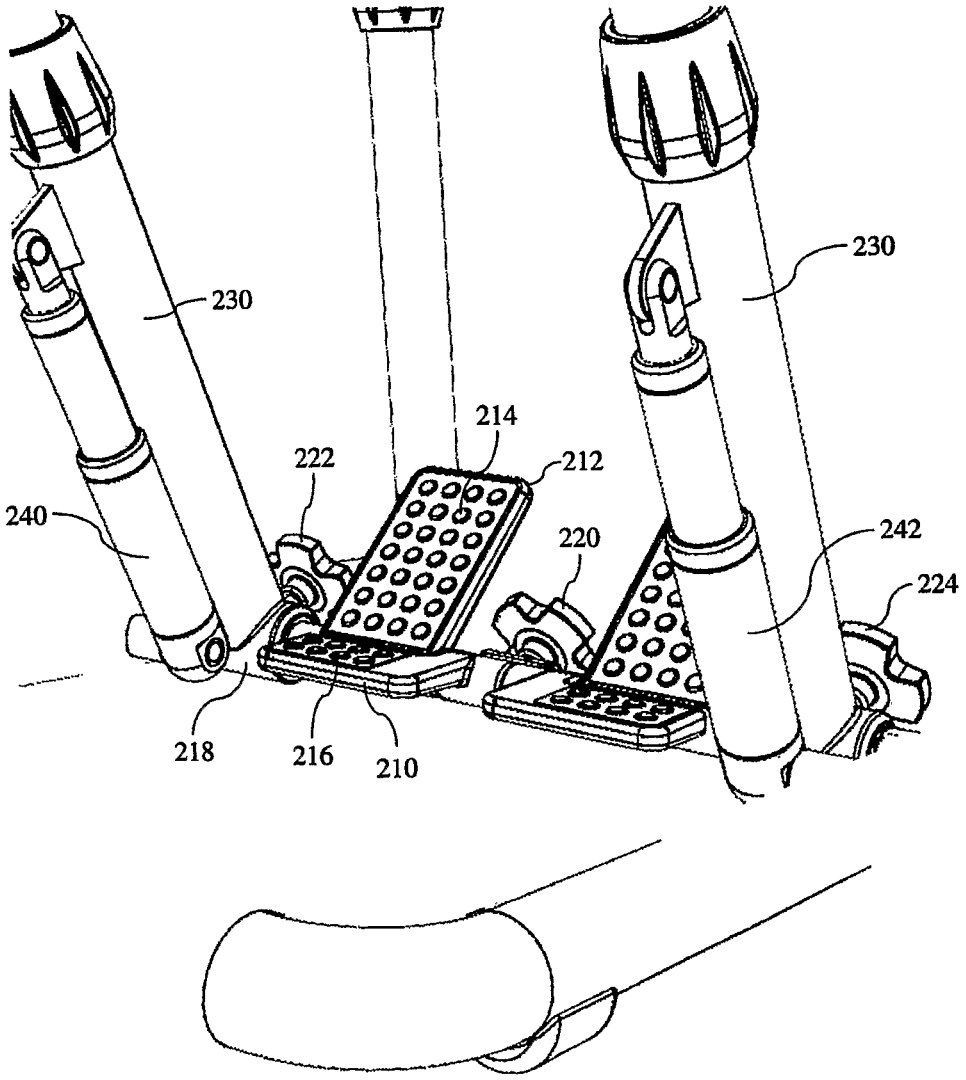
FIG. 3: A detail of foot platforms and foot sensors of the apparatus in FIG. 1.

Referring to FIG. 3, the initial or default angle of the foot platforms (212) can be adjusted for the left and right foot individually by using the two adjustment screws (222, 224). The main leg supports (230) rotates around a bearing (218) with main part of the foot platform (212) during the exercise. The angle of the top part of the foot platform (210) can be adjusted using the adjustment screw (220). The top part of the foot platform (210) does not move during the exercise. The sensors (211) on the foot platforms (212)) are sensor arrays (211) measuring the actual force applied to the surface at the different sensing areas or—points (sensing grid). The sensors can also be implemented as an angle decoder on the bearing (218), or a linear motion sensor. The actuators (240, 242) which are fastened at each end at a bearing (244, 246) and the main leg supports (230, 232) are also shown in the FIG. 3.

Figure 4:
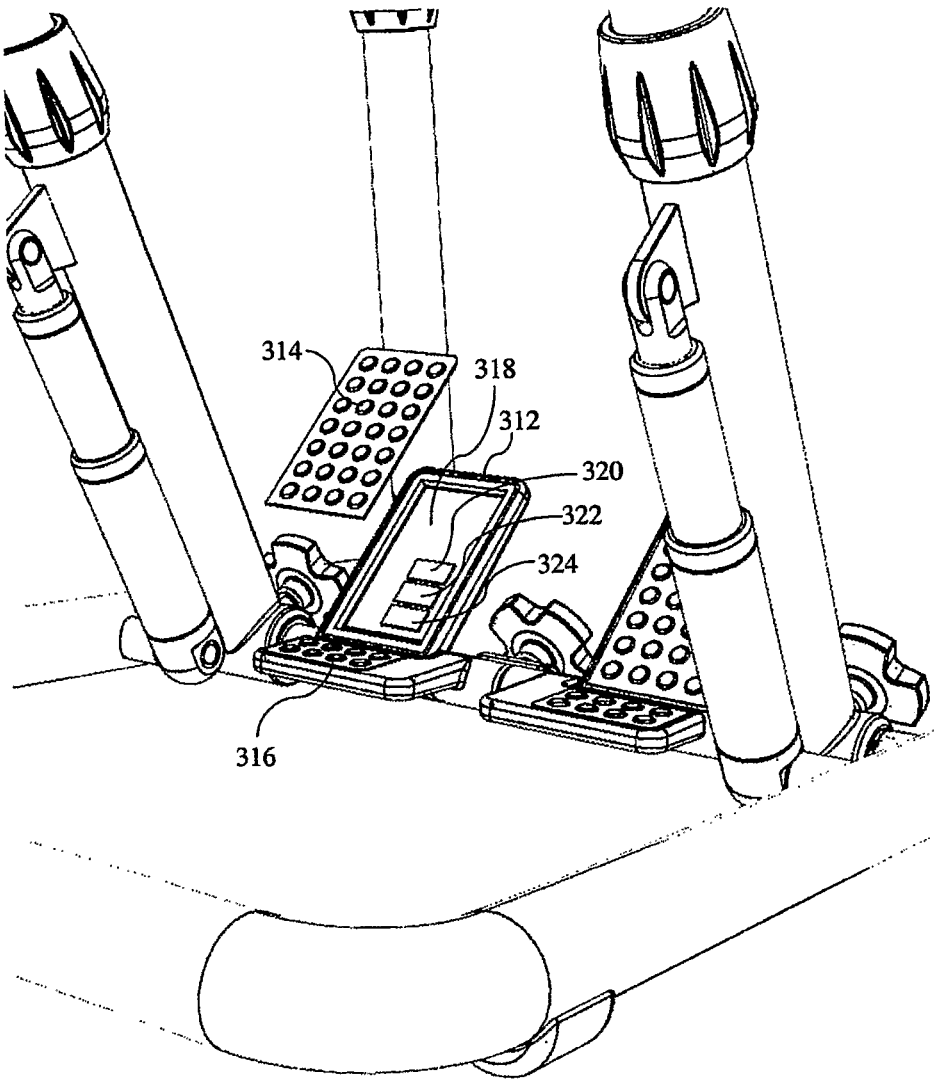
FIG. 4: A detail showing an interface of the apparatus in FIG. 1.

Referring to FIG. 4, the controller (390) acts as interface between the sensors, actuators and the user interface. The controller (390) is placed inside the foot platform under the sensor plate (311). The interface (390) comprises a sensor interface circuit (396), microcontroller (394) and an actuator control circuit (392). The interface may comprise various interface options like wireless connections, USB, Ethernet and others for connection to a user interface.

Figure 5:
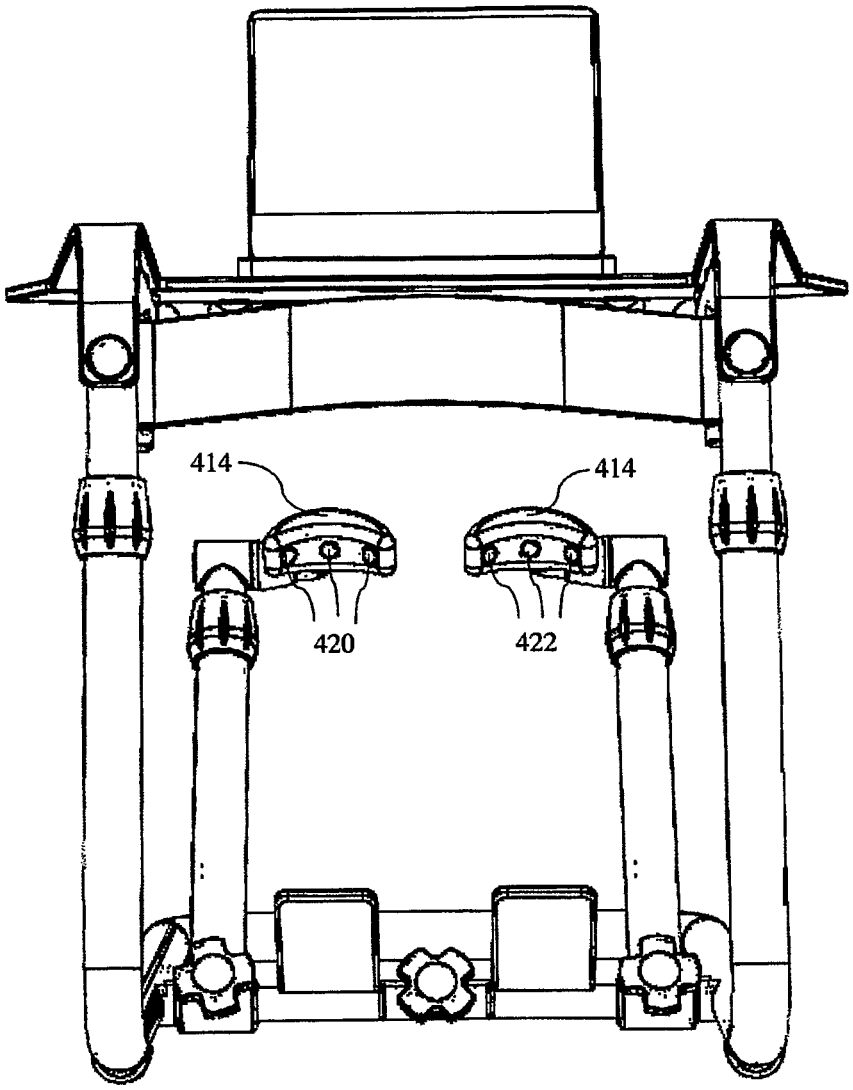
FIG. 5: Leg support pad sensors of the apparatus in FIG. 1.

Referring to FIG. 5, the sensors (415) on the leg support pads (414) are sensor arrays measuring the actual force applied to the surface of the leg support pad (414) at the different sensing areas or —points (sensing grid).

Figure 6:
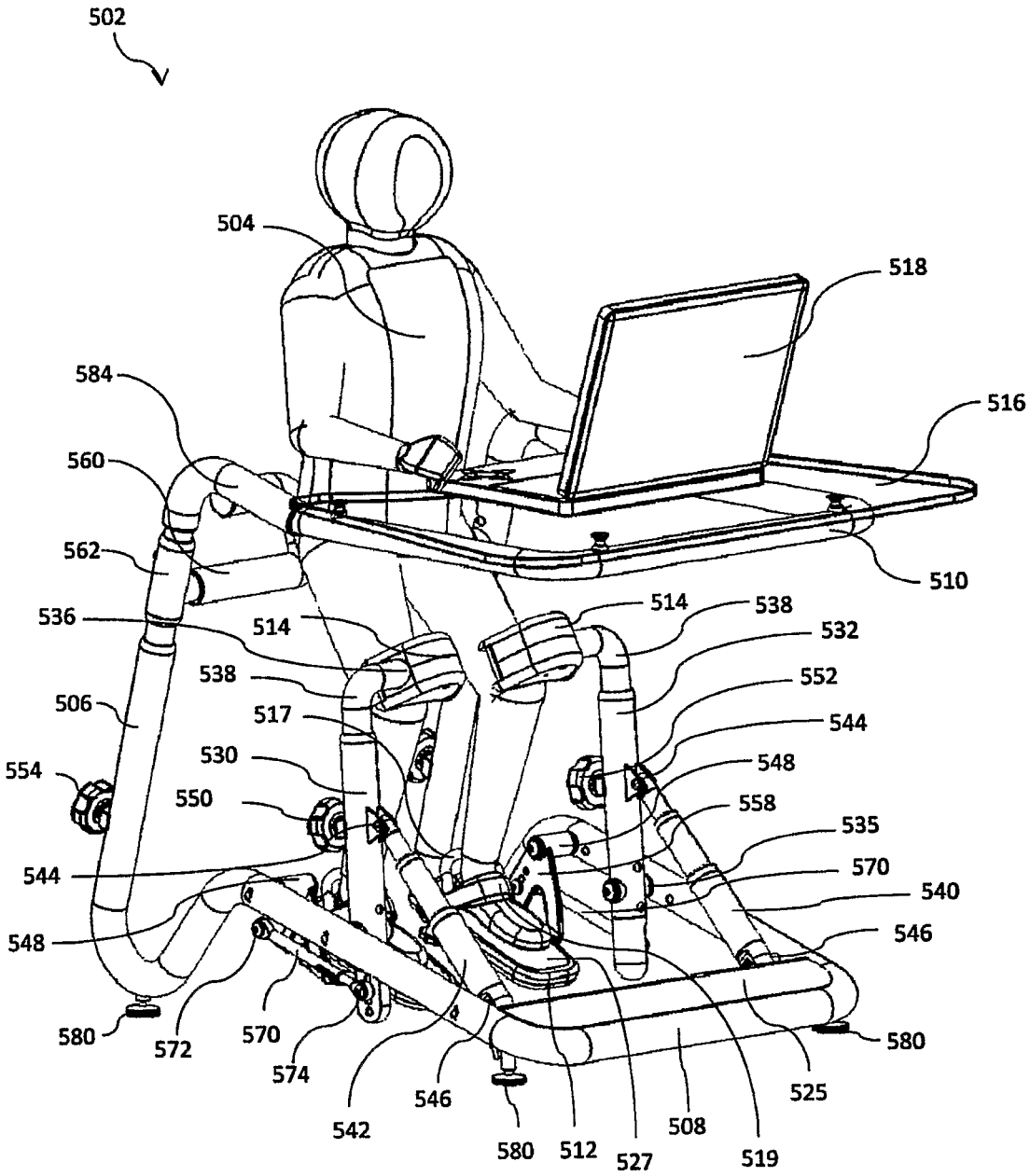
FIG. 6: The exercise apparatus according to the invention in a perspective view from the front.

Referring to FIG. 6, a second embodiment of the exercise equipment (502) is shown in a front/side view. A person using the equipment (504) is not a part of the invention. The height of the table (516) may be adjusted by adjustment screws (554) on the vertical support (506). The lower horizontal support frame (508) and the feet (580) ensure that the exercise equipment (502) is stable during exercising. The upper support frame (510) holds the table plate (516) where a user interface, e.g. a laptop computer (518) or gaming device can be placed. The legs of person using the exercise equipment (504) are positioned against the leg support pads (514) and the feet on the force sensor overlay (527) on foot platforms (512), where the heel bracket (517) and the foot strap (519) help positioning the feet on the foot platforms (512). Each foot platform (512) is mounted on a foot platform bracket (558) which can rotate around the bearing (548) where they are fastened to the lower horizontal support frame (508). The height of the leg supports pads (514) can be adjusted by the adjustment screws (550, 552). Each leg support comprises a support pad (514) with integrated force sensors (715, FIG. 8), an extension part (538), a bearing (536), the main leg support (530, 532) and a linear actuator (540, 542). The main leg support (530, 532) is rotatable around the bearing (535) where it is fastened. Each end of the actuators (540, 542) is fastened at a bearing (544, 546). To further hold and support the person using the exercise equipment in the right position a back support (560) with an opening mechanism (562) is placed at the bottom of the user (504) and two side supports (584). When a linear movement of the one of the actuators (540, 542) is performed the corresponding foot platform (512) will turn accordingly helped by the exchange arm (570) which is mounted at a bearing (572) on the foot platform bracket (558) and at another bearing (574) at the lower end of the main leg support (530, 532). The controller is placed under the cover (525).

Figure 7:
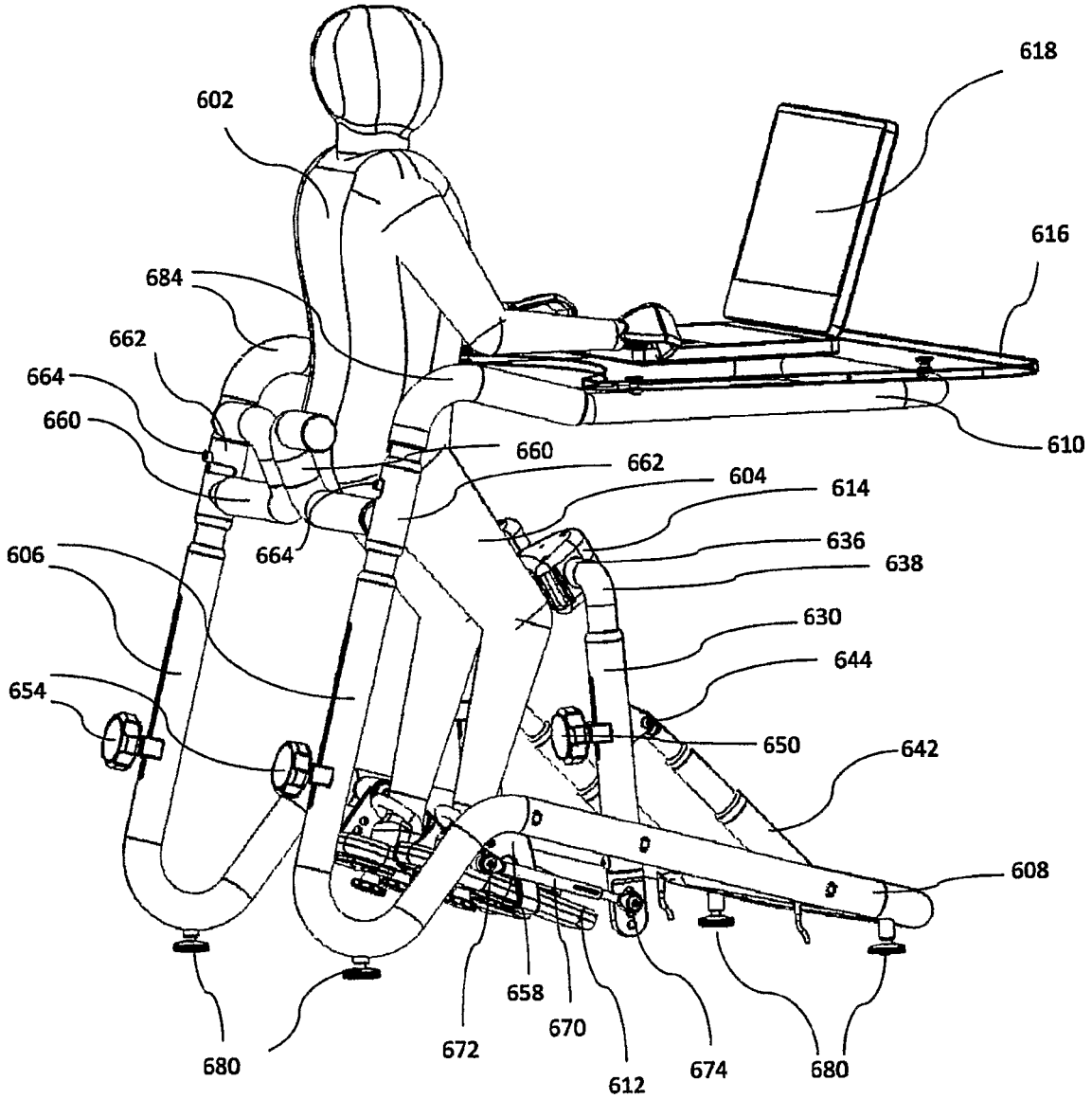
FIG. 7: The exercise apparatus in FIG. 6 in a perspective view from the left side.

Referring to FIG. 7, the legs (604) of the user is shown positioned against the leg support pad (614). The leg support pads (614) have integrated force sensors (715, FIG. 8) to measure the actual force the user is applying to the leg support pad (614). The leg support pad (614) can rotate around a bearing (636) to fit angle of the leg during the exercises. The position of the leg support pads (614) can be adjusted using the adjustment screws (650). The actuators (640, 642) and the main leg supports (630) shall help moving the leg support pad (614) in a mainly horizontal direction. By moving the leg support pad (614) in a mainly horizontal direction the corresponding foot platform will rotate around a bearing. The default or offset angle between the main leg support (630) and the corresponding foot platform (612) can be adjusted by changing the length of the exchange arm (670). The angular gearing between the main leg support (630) and the foot platform (612) can be adjusted by mounting one or both of the bearings (672) or (674) into another position (hole) on the foot platform bracket (674) or on lower end of the main leg support (630).

Figure 8:
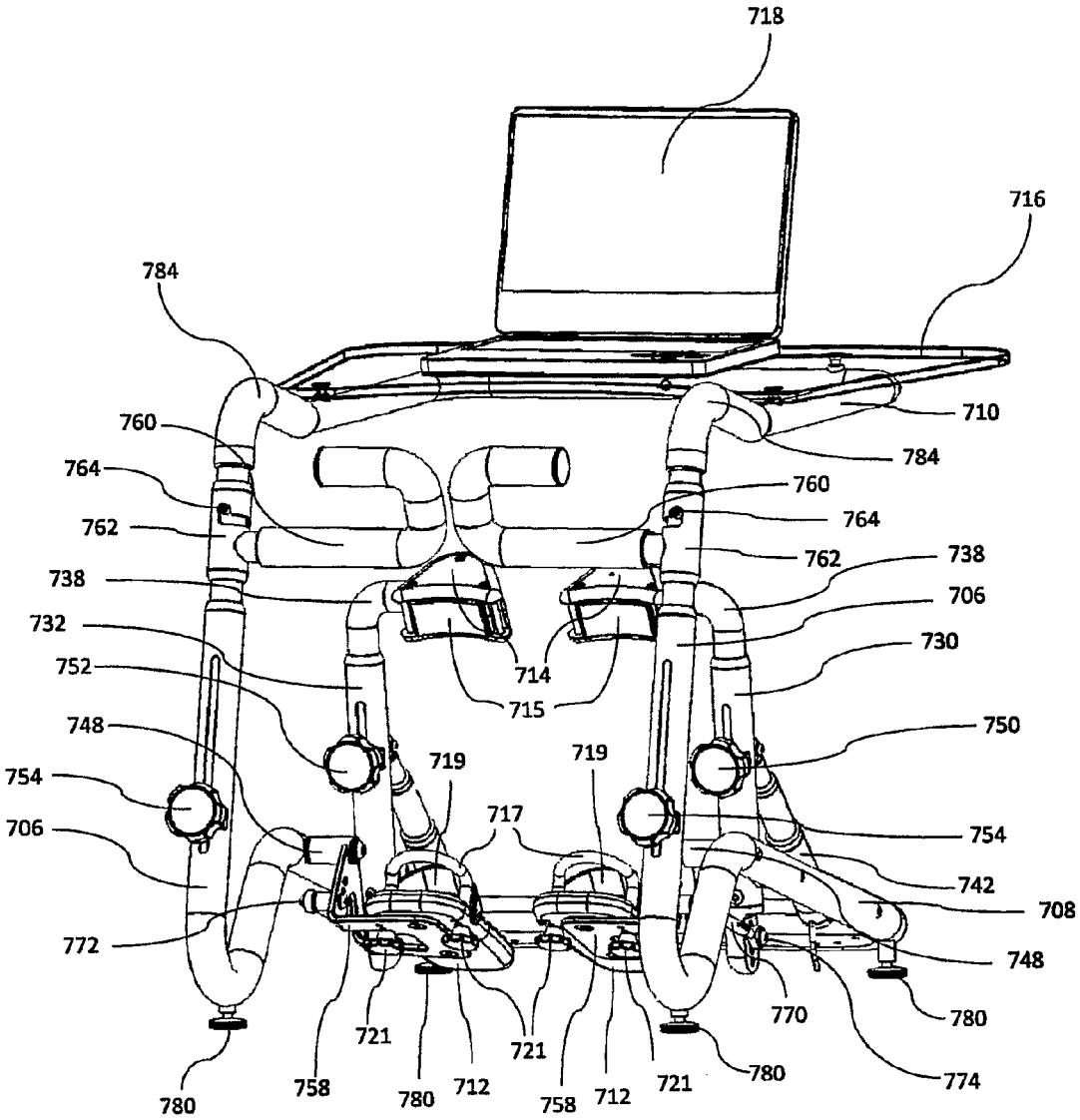
FIG. 8: The exercise apparatus in FIG. 6 in a perspective view from the back side.

Referring to FIG. 8, the initial or default angle of the foot platforms (712) can be adjusted for the left and right foot individually by changing the length of the corresponding exchange arm (770). The angular gearing between the main leg supports (730, 732) and the foot platforms (712) can be adjusted by mounting one or both of the bearings (772) or (774) into another position (hole) on the foot platform bracket (758) or on lower end of the main leg support (730, 732). The heel bracket (717) is mounted on the foot platform (712) by the screws (721). The foot platforms (712) are mounted on the foot platform brackets (758). The back supports (760) can be lifted, released from the fixing tap (764) and rotated around a bearing (762) to easing getting in and out of the exercise equipment. The leg force sensors (715) are mounted on the leg supports pads (714) to measure the exerted force on the leg support pads (714). Furthermore a laptop computer/user interface (718), the table plate (716), the upper support frame (710), side supports (784), vertical support frame (706), adjustment screws (750, 752, 754), feet (780), the extension parts of the leg support (738) and foot straps (719) are shown in FIG. 8.

Figure 9:
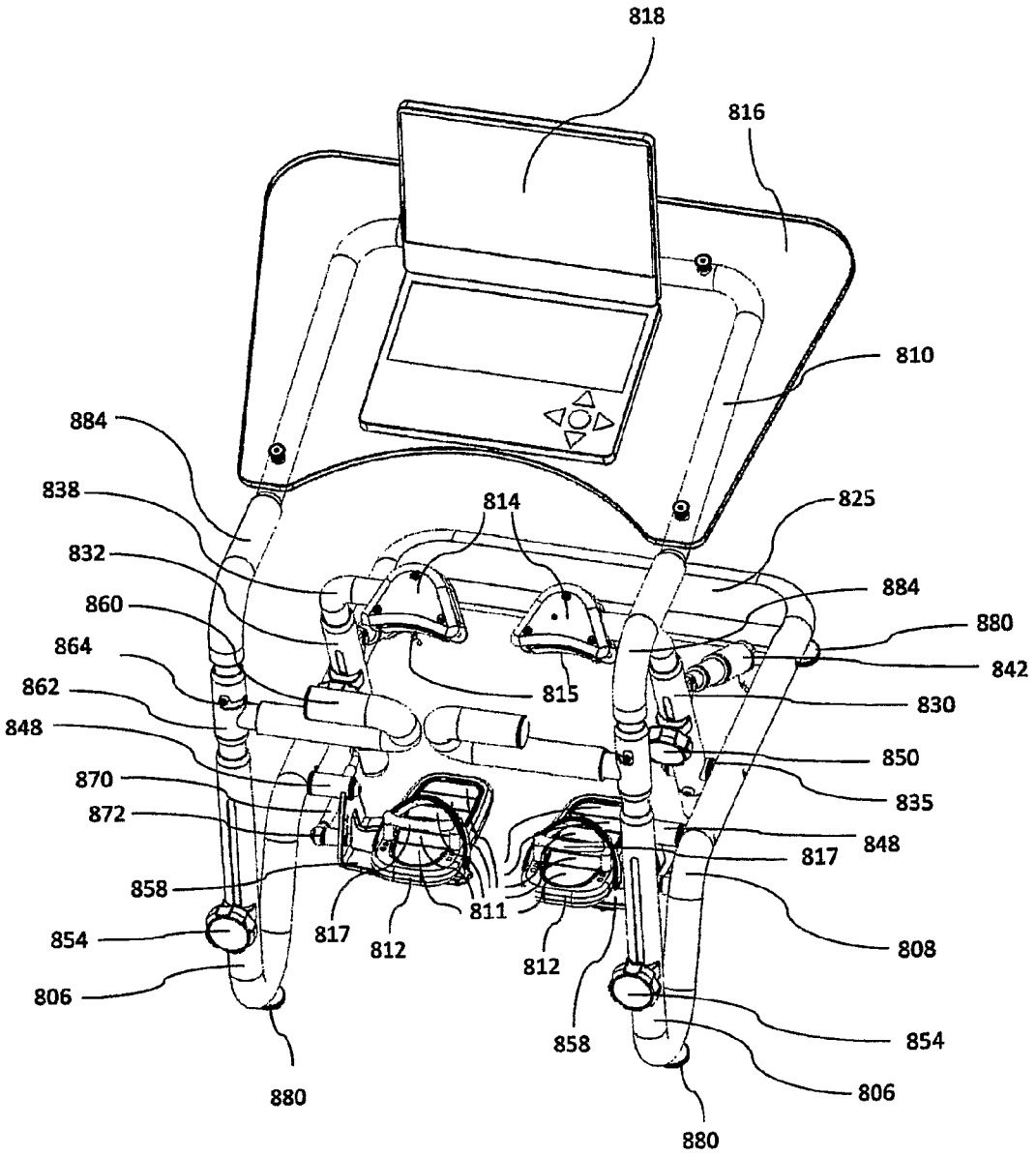
FIG. 9: A detail of the foot platforms and foot sensors of the apparatus in FIG. 6.

Referring to FIG. 9, the controller and interface between the sensors, actuators and the user interface (818) is placed inside the control box (825). The foot platforms are shown without the force sensor overlay (527, FIG. 6), hereby the actual force sensors (811) are shown. The force sensors (811) measure the actual force exerted on each sensor area (811). The sensors on the foot platforms (811) are sensor arrays measuring the actual force applied to the surface at the different sensing areas (811). The sensors can also be implemented as an angle decoder any of the bearings (835, 848, 872), or a strain gauge in connection with the exchange arm (870) or a linear motion sensor. A user interface (818), table plate (816), the upper horizontal support frame (810), side supports (884), vertical support frame (806), adjustment screws (850, 854), feet (880), the extension parts of the leg support (838), the actuators (842), the main leg supports (830, 832), the foot platform brackets (858) and heel bracket (817) are also shown in FIG. 9.

Figure 10:
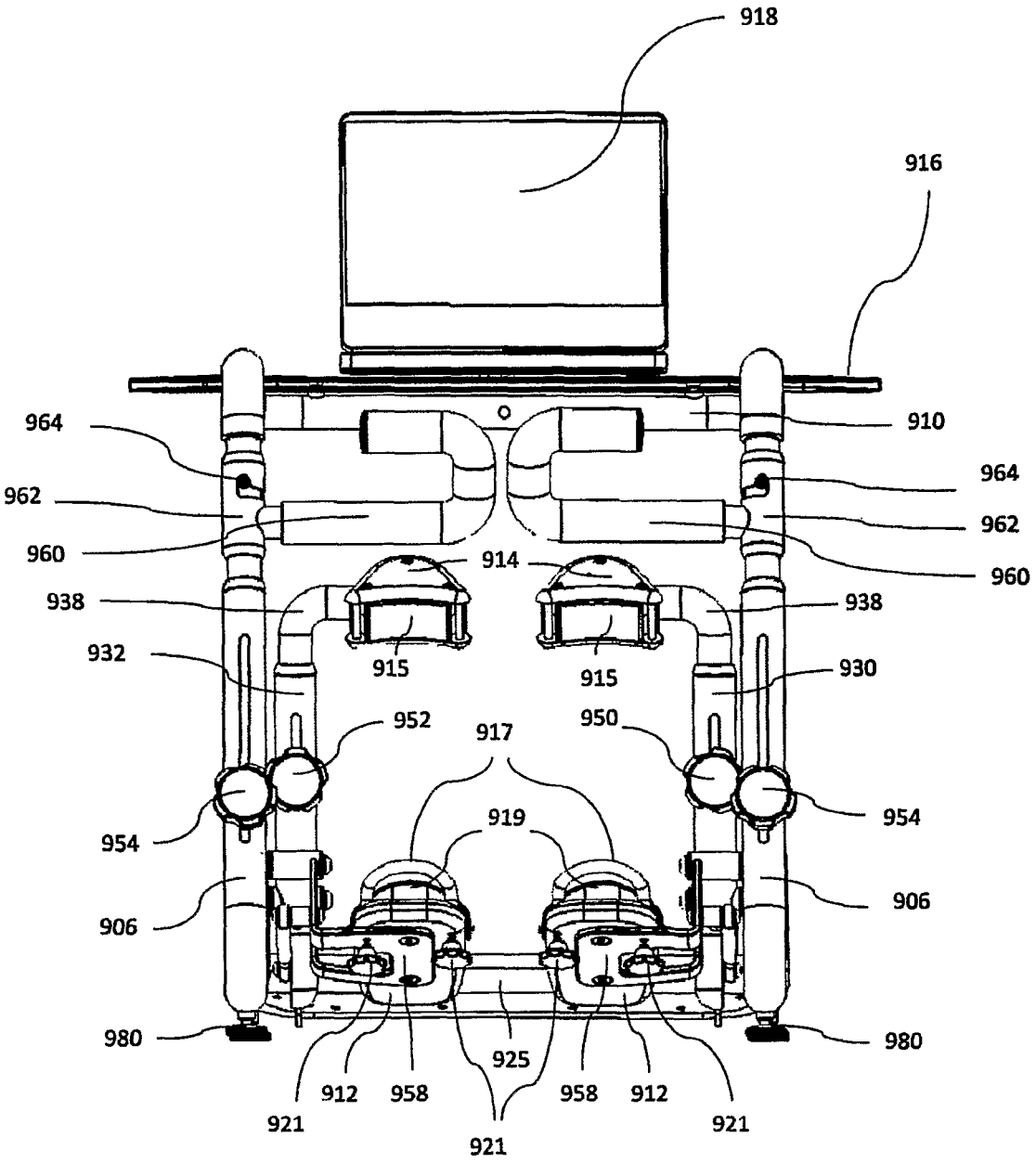
FIG. 10: A detail of the leg support pad sensors of the apparatus in FIG. 6.

Referring to FIG. 10, the exercise equipment is shown from the back side where the force sensors (915) on the leg support pads (914) can be seen. The other elements in FIG. 10 are: User interface (918), table (916), upper frame (910), the back support (960) with open mechanism (962, 964), the extension part (938) for the leg support pads, the main leg supports (930, 932), adjustment screws (950, 952, 954), the vertical supports (906), feet (980), heel bracket (917), foot straps (919), the bracket (958) for the foot platforms, the foot platforms (912), the screws (921) for the heel bracket (917) and the cover (925) for the controller.

Figure 11:
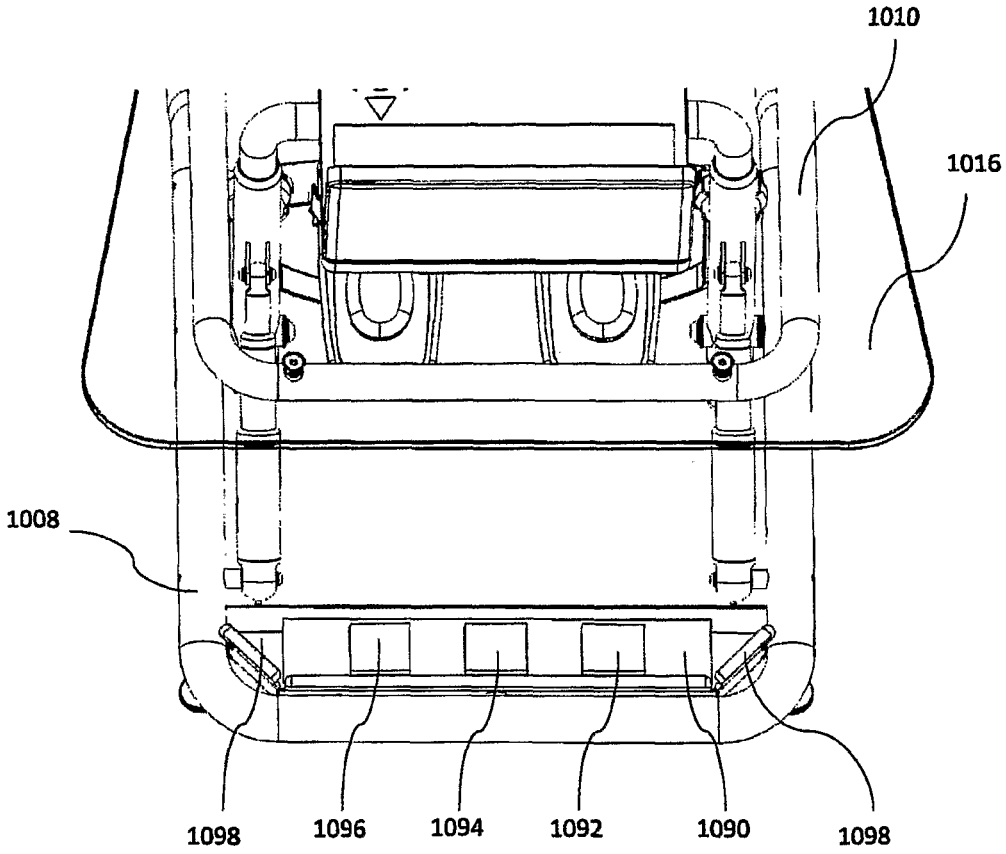
FIG. 11: A detail of the controller of the apparatus in FIG. 6.

Referring to FIG. 11, the exercise equipment is shown from the top side where the cover (925, FIG. 10) for the controller has been removed. The mounting bracket (1098) for the controller holds the controller (1090). The controller comprises a sensor interface (1096), an actuator control circuit (1092) and a microcontroller (1094) with build-in interface for the user interface. This interface may comprise various options like wireless connections, USB, Ethernet and others for connection to a user interface. Also shown in FIG. 11 are the upper frame (1010), table (1016) and the lower horizontal support frame (1008).

Figure 12:
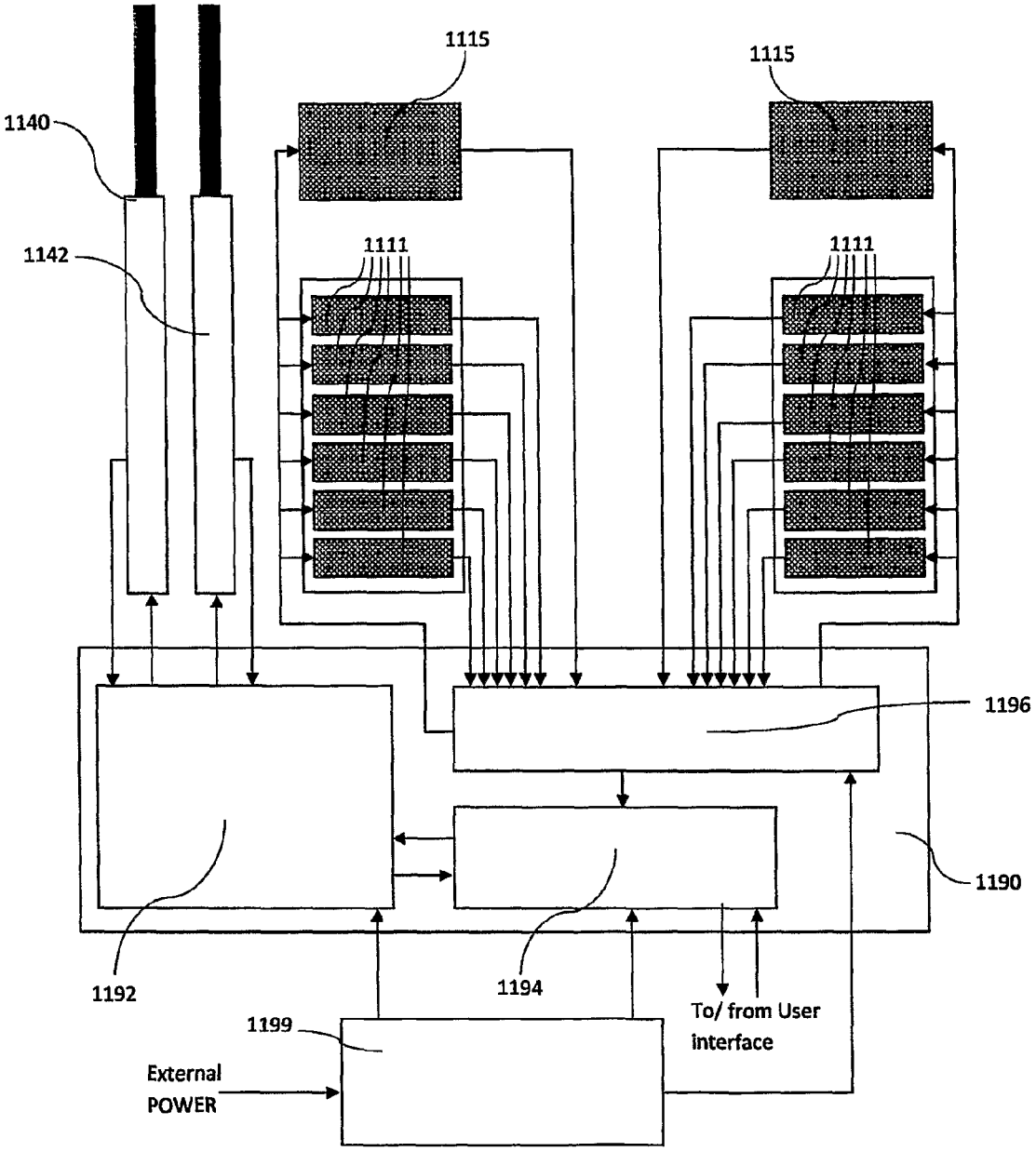
FIG. 12: An electrical block schematic of the controller of the apparatus according to the invention in FIG. 6.

Referring to FIG. 12, an electrical block schematic is shown. The block schematic shows the main parts in the controller (1190), the two actuators (1140, 1142), the two leg force sensors (1115), the two force sensor arrays (1111) at the foot platforms and a power supply (1199). The controller (1190) comprises an actuator controller (1192), sensor interface (1196) and a microcontroller (1194) with build-in interface for the user interface. The power supply (1199) converts the mains power to a low voltage DC supply to supply the rest of the circuit. The actuators have integrated hall elements to indicate the position of the actuators. The actuator controller interface (1192) controls the speed and position of the actuators by varying the DC output and polarity by pulse width modulation (PWM), and decoding the hall quadrature position output of the actuators. The leg force sensors (1115) and the force sensors (1111) at the foot platforms converts the exerted force exerted orthogonally at the surface of each sensor area to an electrical resistance. Hereby a measure of the exerted force can be converted to a digital signal by the sensor interface (1196). The sensor interface (1196) comprises a resistance to voltage converter and an analogue to digital converter (DAC). The microcontroller (1194) translates the digital signal from the sensor interface (1196), the position of the actuators from the actuator control interface (1192) into usable data to the user interface.

Figure 13:
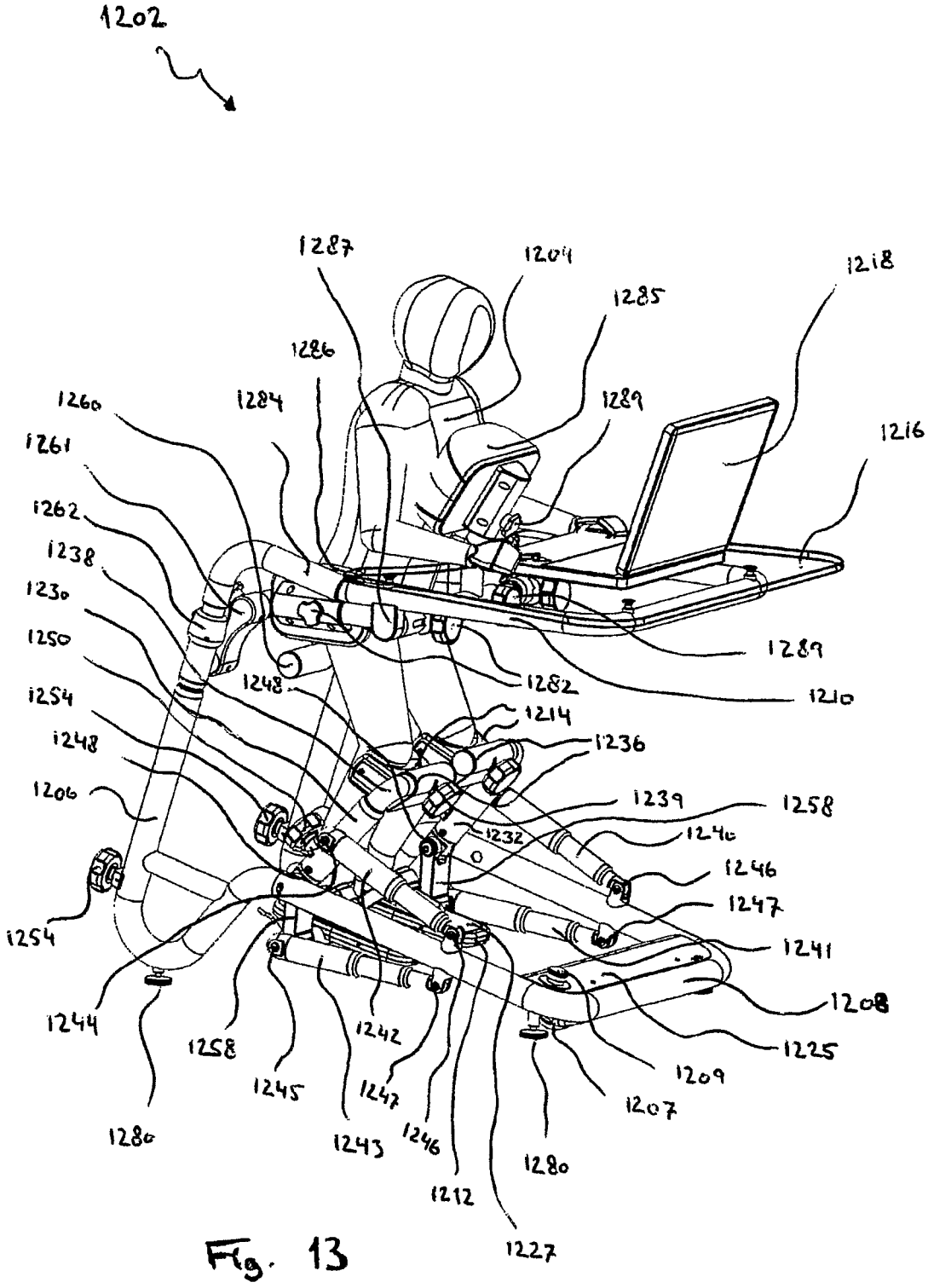
FIG. 13: The exercise apparatus according to the invention in a perspective view from the front.

Referring to FIG. 13, a third embodiment of the exercise equipment (1202) is shown in a front/side view. A person using the equipment (1204) is not a part of the invention. The height of the table (1216) may be adjusted by adjustment screws (1254) on the vertical support (1206). The lower horizontal support frame (1208) and the feet (1280) ensure that the exercise equipment (1202) is stable during exercising. Alternatively one or more wheels can be mounted instead of one or more of the feet (1280). The upper support frame (1210) holds the table plate (1216) where a user interface, e.g. a laptop computer (1218) or gaming device can be placed. The legs of person using the exercise equipment (1204) are positioned against the leg support pads (1214) and the feet on the force sensor overlay (1227) on foot platforms (1212), where the heel bracket and the foot strap help positioning the feet on the foot platforms (1212). Each foot platform (1212) is mounted on a foot platform bracket (1258) which can rotate around the bearing (1248) where they are fastened to the lower horizontal support frame (1208). One actuator (1241, 1243) is fastened between each foot platform bracket (1258) and the lower horizontal support frame (1208). Each end of the actuators (1241, 1243) are rotatable fastened and at a bearing (1245, 1247).

The height of the leg supports pads (1214) can be adjusted by the adjustment screws (1250) and the angle of the leg support pads (1214) by the adjustment screws (1239). Each leg support comprises a support pad (1214) with integrated force sensors (1515, FIG. 16), an extension part (1238), a bearing (1236), the main leg support (1230, 1232) and a linear actuator (1240, 1242). The main leg support (1230, 1232) is rotatable around the bearing (1248) where it is fastened. Each end of the actuators (1240, 1242) is rotatable fastened at a bearing (1244, 1246). To hold and support the person using the exercise equipment in the right position a back support (1260) with an adjustment bracket (1261) and an opening mechanism (1262) is placed at the bottom of the user (1204). Further an upper support system comprising two side supports (1284), two side cushions (1286), a chest cushion (1285) and brackets (1287) supports the user in the correct position. The position of the side cushions (1286) can be adjusted by using the adjustment screw (1282) and the position of the chest cushion (1285) can be adjusted by using the adjustment screw (1289).

When a linear movement of the one of the actuators (1241, 1243) is performed the corresponding foot platform (1212) will turn accordingly around a bearing (1248) on which the foot platform bracket (1258) holding the foot platform (1212) is mounted.

When a linear movement of the one of the actuators (1240, 1242) is performed the corresponding main leg support (1230, 1232) will turn around a bearing (1248), hence a movement of the leg support pad (1214) in a mainly horizontal direction.

The controller (1690, FIG. 17) controls the actuators based upon the inputs from the sensors and the user configuration. Each actuator may be individually controlled by the corresponding sensor input. E.g. an input from the sensor of one foot platform controls the movement of the same foot platform and an input from the sensor of one leg support pad controls the movement of corresponding leg support pad. Further the controller (1690, FIG. 17) is able to control the movement of both a foot platform and a leg support pad based on one sensor input.

An emergency stop (1209) is provided for the safety of the user, which is placed on the cover (1225) for the controller. Two transportation wheels (1207) are provided.

Figure 14:
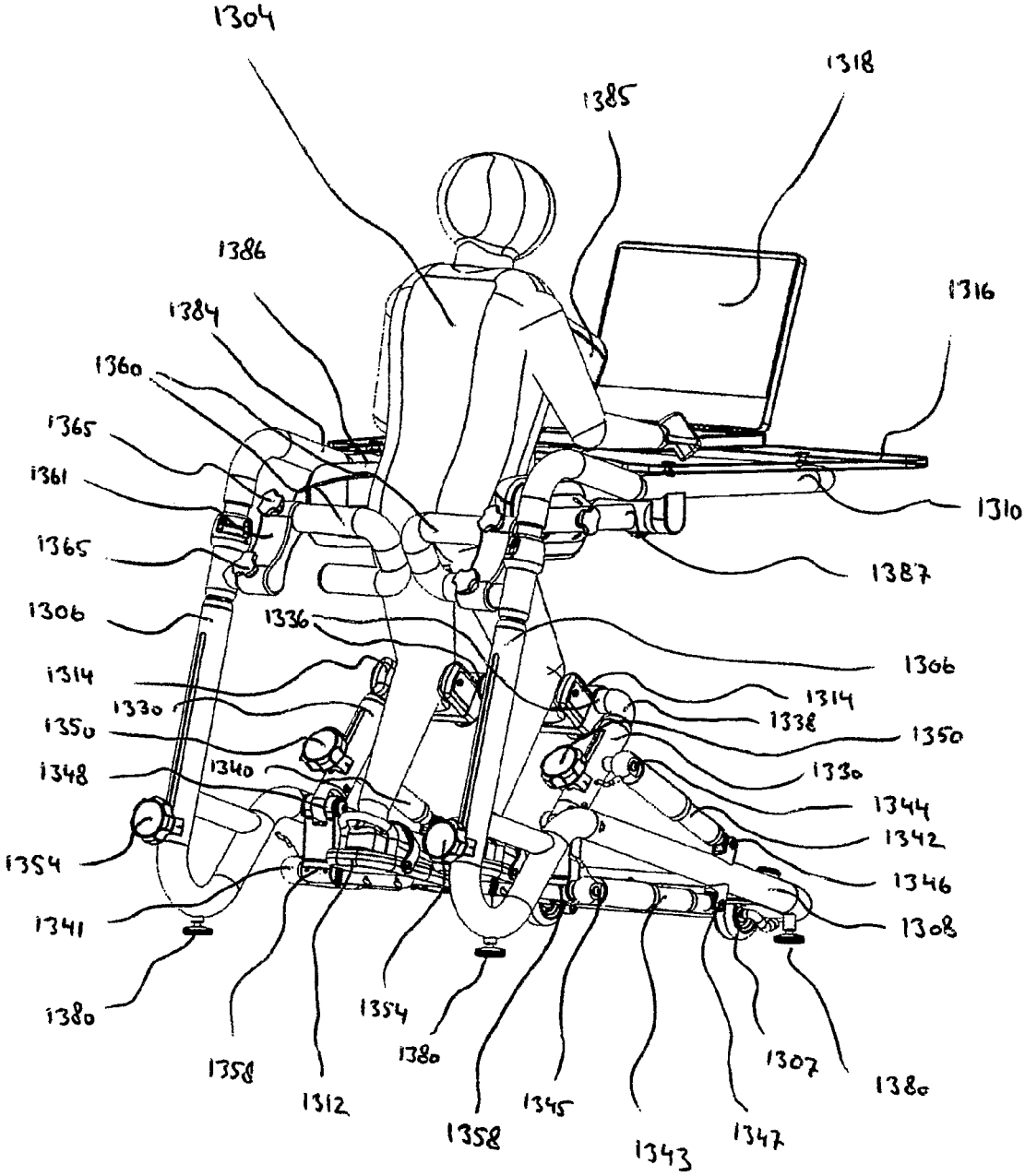
FIG. 14: The exercise apparatus in FIG. 13 in a perspective view from the left side.

Referring to FIG. 14, The exercise apparatus is shown in a perspective view from the left side. The legs of the user (1304) is shown positioned against the leg support pads (1314). The leg support pads (1314) have integrated force sensors (1515, FIG. 16) to measure the actual force the user (1304) is applying to the leg support pad (1314). The leg support pad (1314) can be rotated around a bearing (1336) to fit angle of the leg. The position of the leg support pads (1314) can be adjusted using the adjustment screws (1350). The actuators (1340, 1342), upper leg supports (1338) and the main leg supports (1330) shall help or restricting the movement of the leg support pad (1314) in a mainly horizontal direction. The actuators (1341, 1343) and the foot platform brackets (1358) shall help or restrict the turning of the foot platforms (1312) around the bearing (1348). The position of the main leg support (1330) and foot platform (1312) can be controlled by the controller (1690, FIG. 17) and adjusted via the user interface (1318). The position of each of the actuators (1340, 1341, 1342, 1343), including a static position, minimum and maximum position can hereby be programmed.

Furthermore, if both the foot platform and corresponding leg support pad is supposed to be moving simultaneously the angular gearing between the main leg support (1330) and the foot platform (1312) can be adjusted in the same manner. Alternatively the static position of the foot platform (1312) or leg support pad (1314) can be adjusted. In FIG. 14 the bearings (1344, 1345, 1346, 1347) for the actuators (1340, 1341, 1342, 1343), chest cushion (1385) and brackets (1387), side cushions (1386), side supports (1384) the table plate (1316), the upper support frame (1310), the back support (1360) and adjustment bracket (1361) and screws (1365), the vertical support (1306), the lower frame (1308), the feet (1380), transportation wheels (1307) and the adjustments screws (1350, 1354) are also shown.

Figure 15:
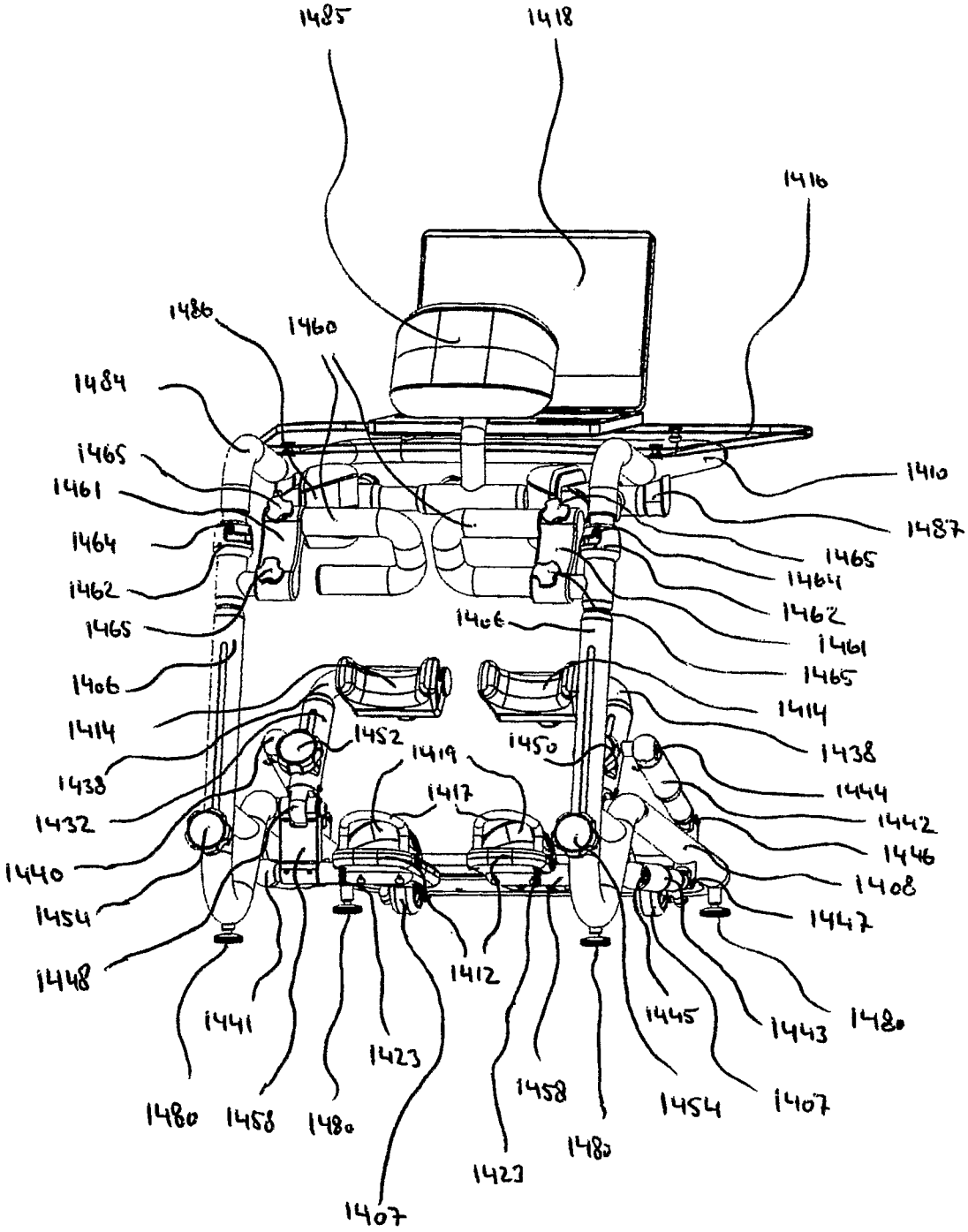
FIG. 15: The exercise apparatus in FIG. 13 in a perspective view from the back side.

Referring to FIG. 15, the exercise apparatus is shown in a perspective view from the back side. The heel bracket (1417) is mounted on the foot platform (1412) by the screws and spring attachment (1423) and the ankle straps (1419) and mounted onto the foot platforms (1412). The foot platforms (1412) are mounted on the foot platform brackets (1458) and rotatable fastened by a bearing (1448) to the frame (1408). The back supports (1460) can be lifted, released from the fixing tap (1464) and rotated around a bearing (1462) to easing getting in and out of the exercise equipment. The position of the back support (1460) can be adjusted by the screws (1465) and the adjustment bracket (1461). The actuators (1440, 1442) are mounted by a bearing (1444, 1446) at each end of them and are able to move the leg support pads (1414) in a mainly horizontal direction. The actuators (1441, 1443) are mounted by a bearing (1445, 1447) at each end of them and are able to rotate the corresponding foot platform (1412) around the bearing (1448). Furthermore a laptop computer/user interface (1418), the table plate (1416), the upper support frame (1410), side supports (1484, 1486), the chest cushion (1485) and bracket (1487), vertical support (1406), adjustment screws (1450, 1452, 1454), feet (1480), the main leg support (1432), extension parts of the leg support (1438) and transportation wheels (1407) are shown in FIG. 15.

Figure 16:
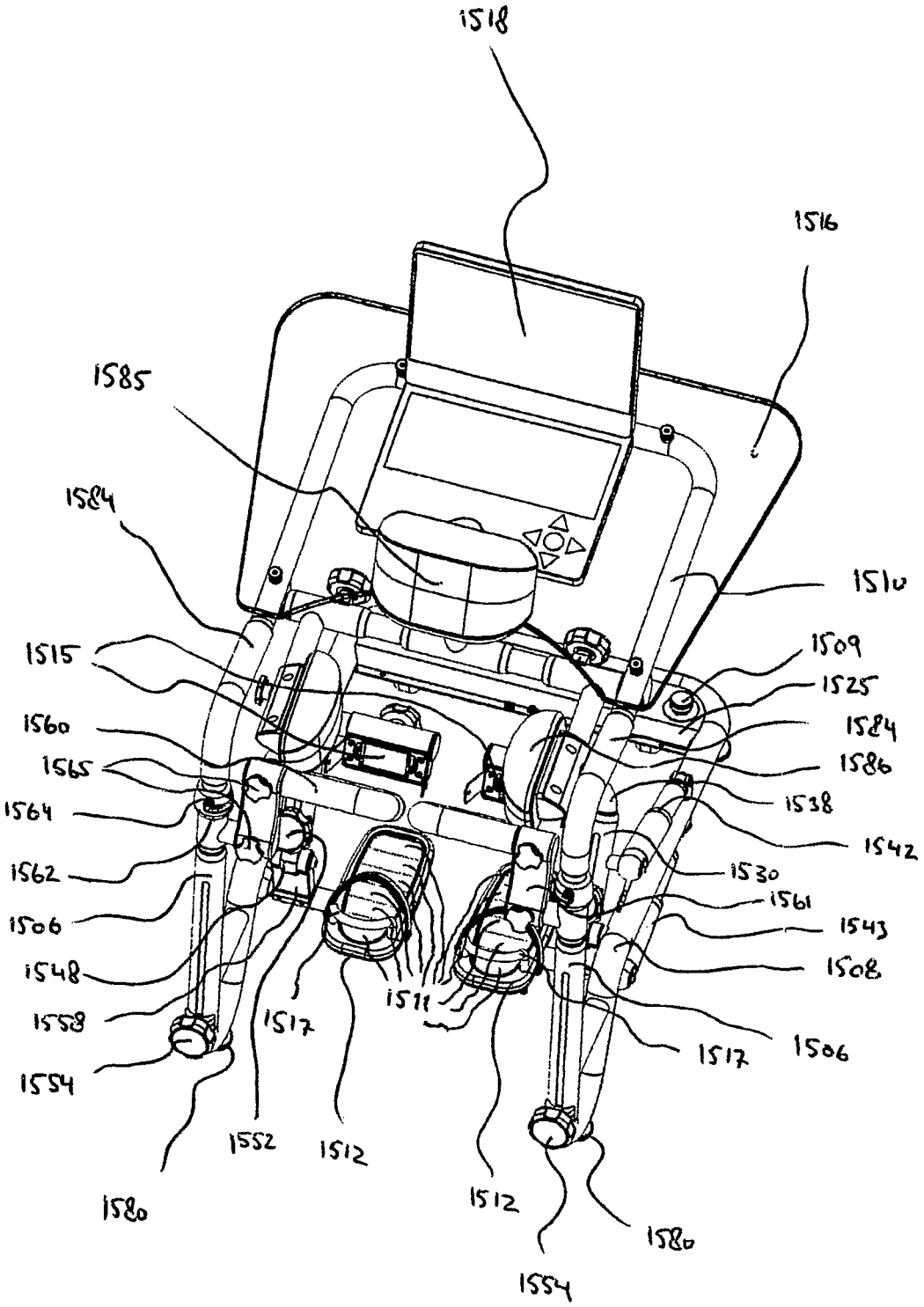
FIG. 16: A detail of the foot platforms and foot sensors and the leg support pad sensors of the apparatus in FIG. 13.

Referring to FIG. 16, the controller and interface between the sensors (1511, 1515), actuators (1542, 1543) and the user interface (1518) is placed inside the control box (1525). The foot platforms (1512) are shown without the force sensor overlay (1227, FIG. 13), hereby the actual force sensors (1511) are shown. The force sensors (1511) measure the actual force exerted on each sensor area (1511). The sensors on the foot platforms (1511) are sensor arrays measuring the actual force applied to the surface at the different sensing areas (1511). The sensors can also be implemented as an angle decoder of the bearing (1548), or a linear motion sensor. The leg force sensors (1515) are mounted on the leg supports pads (1514) to measure the exerted force on the leg support pads (1514).

A user interface (1518), table plate (1516), the upper horizontal support frame (1510), side supports (1584, 1586), chest cushion (1585), back support (1560) and open mechanism (1562, 1564), adjustment bracket (1561) and screws (1565), vertical support frame (1506), adjustment screws (1552, 1554), feet (1580), extension parts of the leg support (1538), actuators (1542, 1543), main leg supports (1530), lower horizontal frame (1508), emergency stop (1509), foot platform brackets (1558) and heel bracket (1517) are also shown in FIG. 16.

Figure 17:
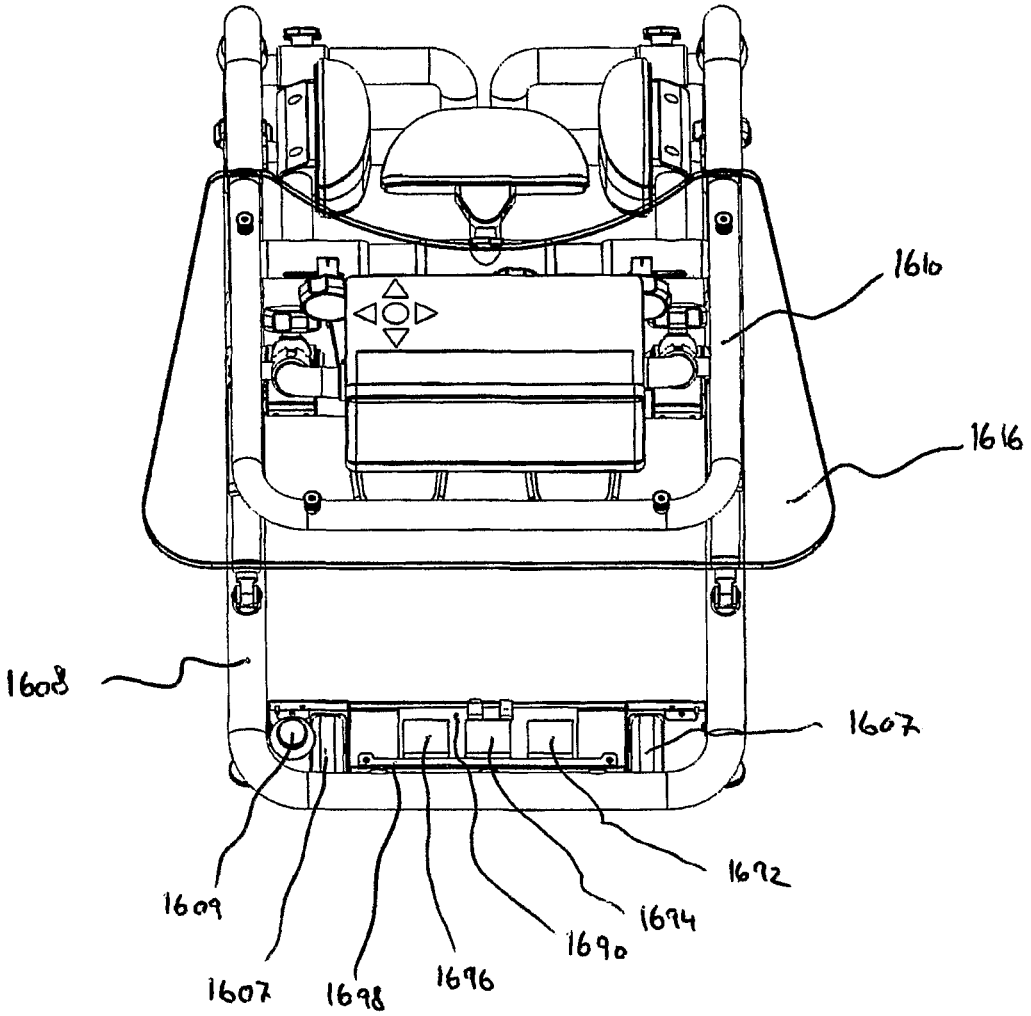
FIG. 17: A detail of the controller of the apparatus in FIG. 13.

Referring to FIG. 17, the exercise equipment is shown from the top side where the cover (1225, FIG. 13) for the controller (1690) has been removed. The mounting bracket (1698) for the controller holds the controller (1690). The controller (1690) comprises a sensor interface (1696), an actuator control circuit (1692) and a microcontroller (1694) with build-in interface for the user interface. This interface may comprise various options like wireless connections, USB, Ethernet and others for connection to a user interface. Also shown in FIG. 17 are the upper frame (1610), table plate (1616), the lower horizontal support frame (1608), emergency stop (1609) and transportation wheels (1607).

Figure 18:
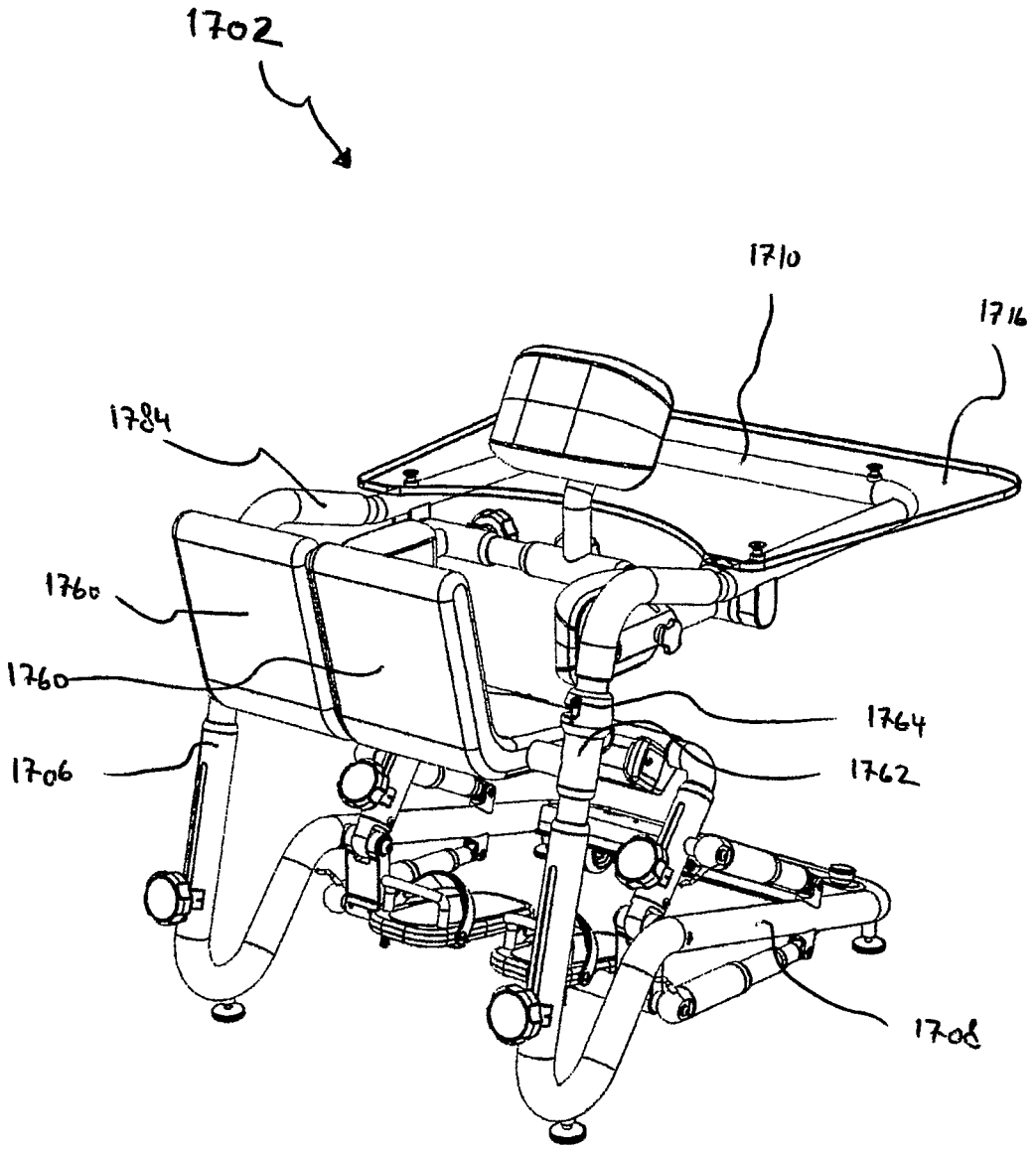
FIG. 18: Indicates a third embodiment of the apparatus according to the invention.

Referring to FIG. 18, a third embodiment of the apparatus according to the invention is shown. The exercise equipment (1702) is show where the back support (1760) is performed as a chair or seat. The back support (1760) can be opened by lifting and turning the two parts of the back support (1760) outward with the help of the opening mechanism (1762, 1764). The opening mechanism (1762, 1764) for the back support (1760) is fastened to the vertical supports (1706). The other elements are similar to the embodiment shown in FIG. 13. Furthermore the table plate (1716), upper frame (1710), lower frame (1708) and side supports (1784) are shown in FIG. 18.

Figure 19:
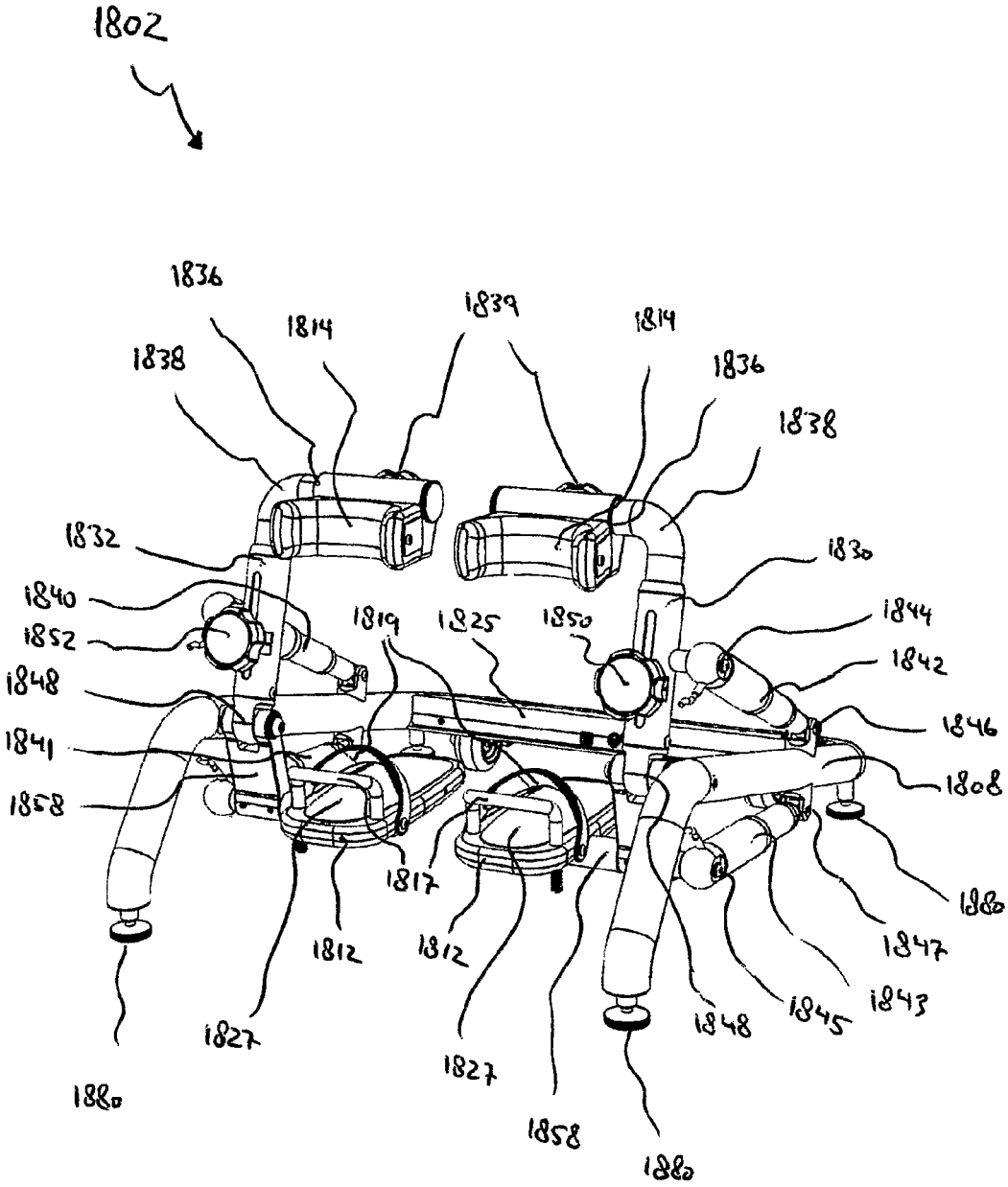
FIG. 19: Indicates a fourth embodiment of the apparatus according to the invention.

Referring to FIG. 19, a fourth embodiment of the apparatus (1802) according to the invention is shown. In this particular embodiment, the invention relates to a standalone module. The lower horizontal support frame (1808) and the feet (1880) ensure that the exercise equipment (1802) is stable during exercising. Alternatively one or more wheels can be mounted instead of one or more of the feet (1880). The leg support pads (1814) and the force sensor overlay (1827) on foot platforms (1812) are shown. Under the force sensor overlay (1827) the actual force sensors (1511, FIG. 16) are placed, measuring the actual force exerted on each sensor area (1511, FIG. 16). The sensors on the foot platforms (1511, FIG. 16) are sensor arrays measuring the actual force applied to the surface at the different sensing areas (1511, FIG. 16). The heel bracket (1817) and the foot strap (1819) help positioning the user's feet on the foot platforms (1812). Each foot platform (1812) is mounted on a foot platform bracket (1858) which can rotate around the bearing (1848) where they are fastened to the lower horizontal support frame (1808). The actuators (1841, 1843) are fastened between each foot platform bracket (1858) and the lower horizontal support frame (1808). Each end of the actuators (1841, 1843) are rotatable fastened and at a bearing (1845, 1847). The height of the leg supports pads (1814) can be adjusted by the adjustment screws (1850, 1852) and the angle of the leg support pads (1814) by the adjustment screws (1839). Each leg support comprises a support pad (1814) with integrated force sensors (1515, FIG. 16), an extension part (1838), a bearing (1836), the main leg support (1830, 1832) and a linear actuator (1840, 1842). The main leg support (1830, 1832) is rotatable fastened to a bearing (1848). Each end of the actuators (1840, 1842) is fastened at a bearing (1844, 1846). When a linear movement of the one of the actuators (1841, 1843) is performed the corresponding foot platform (1812) will turn accordingly around a bearing (1848) on which the foot platform bracket (1858) holding the foot platform (1812) is mounted.

When a linear movement of the one of the actuators (1840, 1842) is performed the corresponding main leg support (1830, 1832) will turn around a bearing (1848), hence a movement of the leg support pad (1814) in a mainly horizontal direction.

The controller (1690, FIG. 17) controls the actuators based upon the inputs from the sensors and the user configuration. Each actuator may be individually controlled by the corresponding sensor input. E.g. an input from the sensor of one foot platform controls the movement of the same foot platform and an input from the sensor of one leg support pad controls the movement of corresponding leg support pad. Further the controller (1690, FIG. 17) is able to control the movement of both a foot platform and a leg support pad based on one sensor input.

The elements shown are similar to the embodiment shown in FIG. 13.

Figure 20:
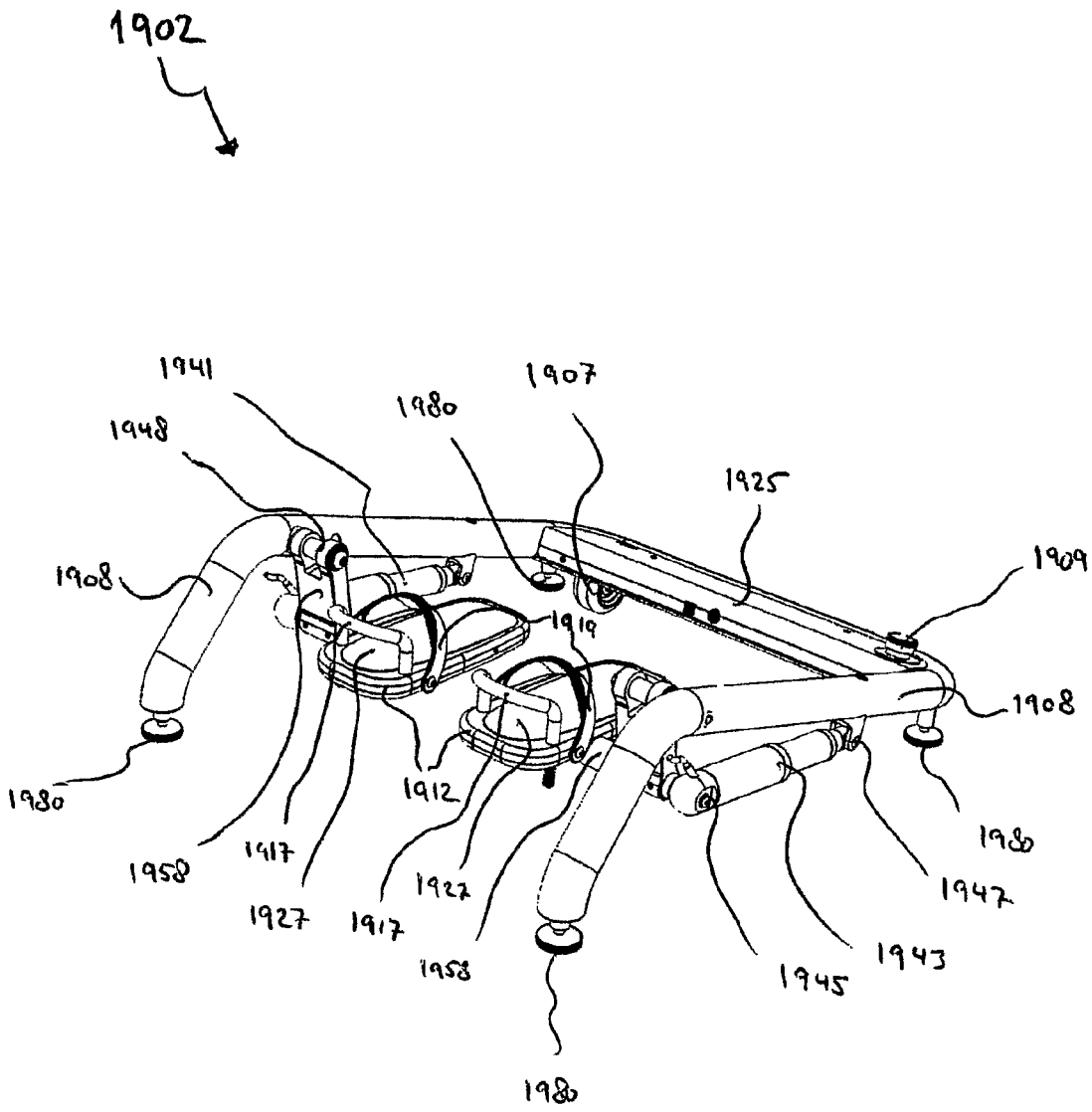
FIG. 20: Indicates a fifth embodiment of the apparatus according to the invention.

Referring to FIG. 20, a fifth embodiment of the apparatus (1902) according to the invention is shown. In this particular embodiment, the invention relates to a standalone module. The lower horizontal support frame (1908) and the feet (1980) ensure that the exercise equipment (1902) is stable during exercising. Alternatively one or more wheels can be mounted instead of one or more of the feet (1980). The force sensor overlay (1927) on foot platforms (1912) is shown. Under the force sensor overlay (1927) the actual force sensors (1511, FIG. 16) are placed, measuring the actual force exerted on each sensor area (1511, FIG. 16). The sensors on the foot platforms (1511, FIG. 16) are sensor arrays measuring the actual force applied to the surface at the different sensing areas (1511, FIG. 16). The heel bracket (1917) and the foot strap (1919) help positioning the user's feet on the foot platforms (1912). Each foot platform (1912) is mounted on a foot platform bracket (1958) which can rotate around the bearing (1948) where they are fastened to the lower horizontal support frame (1908). The actuators (1941, 1943) are fastened between each foot platform bracket (1958) and the lower horizontal support frame (1908). Each end of the actuators (1941, 1943) are rotatable fastened and at a bearing (1945, 1947). When a linear movement of the one of the actuators (1841, 1843) is performed the corresponding foot platform (1912) will turn accordingly around a bearing (1948) on which the foot platform bracket (1958) holding the foot platform (1912) is mounted.

The controller (1690, FIG. 17) is placed under the cover (1925) and controls the actuators (1941, 1943) based upon the inputs from the sensors (1511, FIG. 16) and the user configuration. Each actuator may be individually controlled by the corresponding sensor input. Further the controller (1690, FIG. 17) is able to control the movement of a foot platform (1912) based on one sensor input. An emergency stop (1909) is provided for the safety of the user, which is placed on the cover (1925) for the controller. Two transportation wheels (1907) are provided.

The elements shown are similar to the embodiment shown in FIG. 13.

Figure 21:
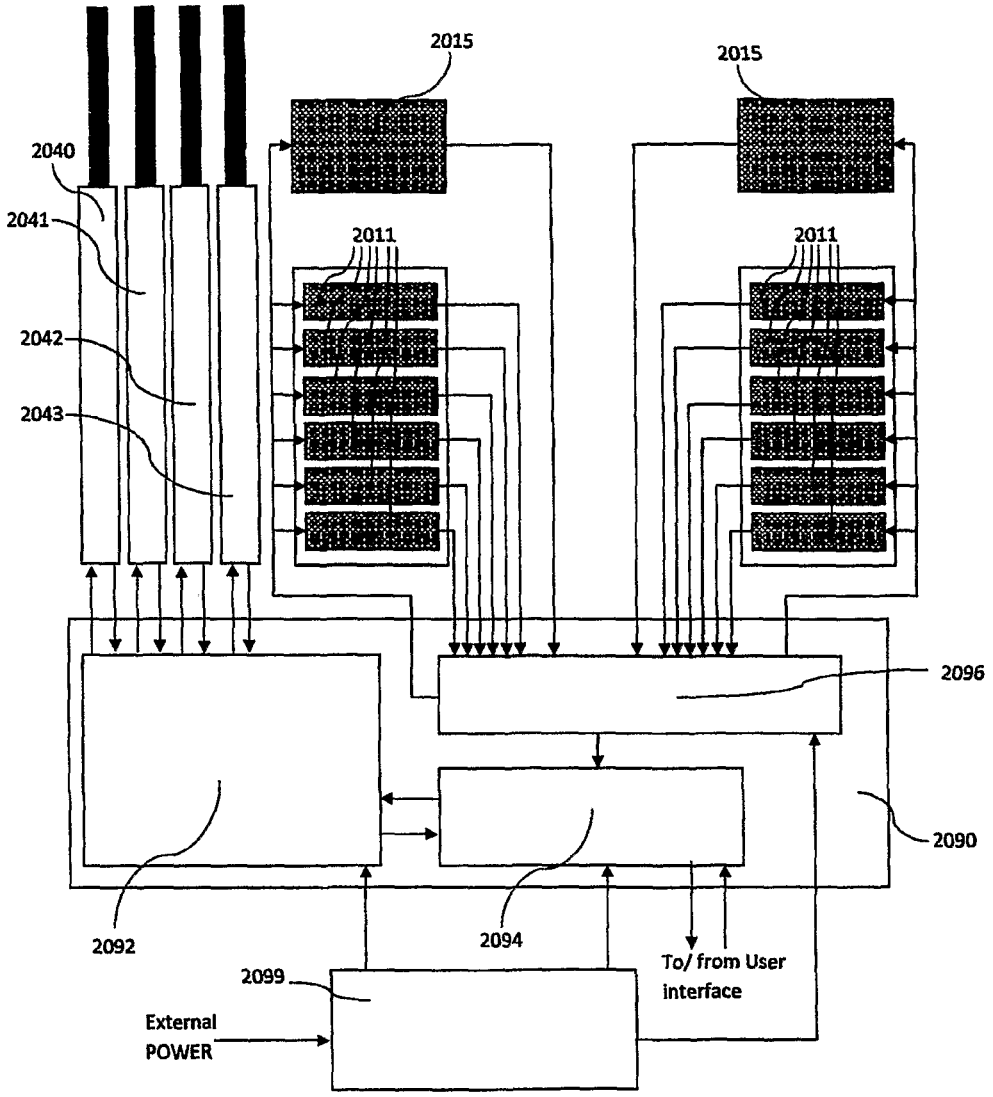
FIG. 21: An electrical block schematic of the controller of the apparatus according to the embodiments in FIGS. 13-20 of the invention.

Referring to FIG. 21, an electrical block schematic is shown. The block schematic shows the main parts in the controller (2090) used where the embodiment comprises 4 actuators. The four actuators (2040, 2041, 2042, 2043), the two leg force sensors (2015), the two force sensor arrays (2011) at the foot platforms and a power supply (2099) are shown. The controller (2090) comprises an actuator controller (2092), sensor interface (2096) and a microcontroller (2094) with build-in interface for the user interface. The power supply (2099) converts the mains power to a low voltage DC supply to supply the rest of the circuit. The actuators have integrated hall elements to indicate the position of the actuators. The actuator controller interface (2092) controls the speed, force and position of the actuators by varying the DC output and polarity by pulse width modulation (PWM), and decoding the hall quadrature position output of the actuators. The leg force sensors (2015) and the force sensors (2011) at the foot platforms converts the exerted force exerted orthogonally at the surface of each sensor area to an electrical measurable signal e.g. a change or variation in the resistance, capacitance or inductance of the sensor. Hereby a measure of the exerted force can be converted to a digital signal by the sensor interface (2096). The sensor interface (2096) comprises a resistance to voltage converter and an analogue to digital converter (DAC). The microcontroller (2094) translates the digital signal from the sensor interface (2096), the position of the actuators from the actuator control interface (2092) into usable data to the user interface and controls the position, speed and force of the actuators (2040, 2041, 2042, 2043).

The invention claimed is:

1. Exercise apparatus for exercising muscle groups in a person's legs by stretching and/or retraction, which exercise apparatus comprises, at least a first frame and at least a first foot platform, mounted on a foot platform bracket which can rotate around a bearing where it is fastened to the first frame, and the foot platform which bearing is placed in relation to the person's foot to allow at least plantar flexion and/or dorsal flexion, which exercise apparatus further comprises a leg support, wherein one or more sensors are provided for measuring the force exerted at the leg support, wherein the position and movement of the leg support is controlled by a signal obtained at one of the sensors at the leg support, and one or more sensors are provided for measuring the force exerted at the foot platform, wherein the position and movement of the foot platform is controlled by a signal obtained by one of the sensors at the foot platform, and that the angular movement of the foot platform is individually controlled in relation to the mostly horizontal movement and/or position of the leg support.

2. Exercise apparatus according to claim 1, characterised in that the exercise apparatus measures at least one force acting at the foot platform which a measured first force dependent signal is transmitted towards a controller based on the first measured force dependent signal controls a second force acting at the foot platform.

3. Exercise apparatus according to claim 1, characterised in that the exercise apparatus measures at least one force acting at the leg support, which a measured first force dependent signal is transmitted towards a controller, which controller based on the first measured force dependent signal controls a second force acting at the leg support.

4. Exercise apparatus according to claim 1, characterised in that the exercise apparatus further comprises at least one support, which support or supports are connected to at least an upper frame.

5. Exercise apparatus according to claim 1, characterised in that at least one foot platform is connected to at least one restriction element.

6. Exercise apparatus according to claim 1, characterised in that at least one foot platform is connected to at least a first actuator.

7. Exercise apparatus according to claim 1, characterised in that the apparatus comprises at least a first electric motor, which electric motor is mechanically connected to at least one foot platform for performing an angular movement of the foot platform.

8. Exercise apparatus according to claim 1, characterised in that at least one leg support is connected to at least a second actuator.

9. Exercise apparatus according to claim 1, characterized in that one or more sensor arrays measure the local actual force at a person's foot or leg.

10. Exercise apparatus according to claim 1, characterized in that the exercise apparatus comprises a controller, which controller receives signals from at least one of the sensors and generates an output signal.

11. Exercise apparatus according to claim 10, characterized in that the output signal is transmitted to a computer system or a gaming device.

12. Exercise apparatus according to claim 10, characterized in that the controller controls the actuators.

13. Exercise apparatus according to claim 12, characterized in that the output signal is transmitted to a user interface.

14. Use of an exercise apparatus according to claim 1, for exercising at least plantar flexion or dorsal flexion of the legs and feet of a person.

15. A method for exercising muscle groups in a person's legs by stretching and/or retraction, wherein the following steps are performed:

providing an exercise device comprising: at least a first frame and at least a first foot platform, mounted on a foot platform bracket which can rotate around a bearing where it is fastened to the first frame, the foot platform bearing being placed in relation to the person's foot to allow at least plantar flexion and/or dorsal flexion; which exercise apparatus further comprises a leg support, wherein one or more sensors are provided for measuring the force exerted at the leg support, wherein the position and movement of the leg support is controlled by a signal obtained at one of the sensors at the leg support, and one or more sensors are provided for measuring the force exerted at the foot platform; wherein the position and movement of the foot platform is controlled by a signal obtained by one of the sensors at the foot platform, and the angular movement of the foot platform is individually controlled in relation to the mostly horizontal movement and/or position of the leg support;

placing a foot on one of said at least one foot platform; measuring the force exerted at the foot platform; controlling the position and movement of the foot platform based on said signal obtained by one of the sensors at the foot platform, and/or placing a leg on said leg support; measuring the force exerted at the leg support; controlling the position and movement of the leg support based on said signal obtained at one of the sensors at the leg support;

wherein in the method, the angular movement of the foot platform is individually controlled in relation to the mostly horizontal movement and/or position of the leg support.

* * * * *